US009427982B2

(12) United States Patent
Ohashi et al.

(10) Patent No.: US 9,427,982 B2
(45) Date of Patent: Aug. 30, 2016

(54) RECORDING APPARATUS

(71) Applicant: SEIKO EPSON CORPORATION, Tokyo (JP)

(72) Inventors: Kazuyoshi Ohashi, Matsumoto (JP); Akinobu Nakahata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/221,844

(22) Filed: Mar. 21, 2014

(65) Prior Publication Data

US 2014/0292976 A1 Oct. 2, 2014

(30) Foreign Application Priority Data

Mar. 29, 2013 (JP) ..... 2013-071633
Mar. 29, 2013 (JP) ..... 2013-072571

(51) Int. Cl.

| | |
|---|---|
| ***B41J 2/01*** | (2006.01) |
| ***B41J 11/04*** | (2006.01) |
| ***B41J 3/60*** | (2006.01) |
| ***B65H 85/00*** | (2006.01) |

(52) U.S. Cl.

CPC . *B41J 11/04* (2013.01); *B41J 3/60* (2013.01); *B65H 85/00* (2013.01); *B65H 2301/333* (2013.01); *B65H 2301/33214* (2013.01); *B65H 2801/06* (2013.01)

(58) Field of Classification Search

CPC .... B41J 13/0027; B41J 13/02; B41J 13/103; B41J 3/60; B65H 5/06
USPC ..... 347/101, 104; 399/364
See application file for complete search history.

(56) References Cited

U.S. PATENT DOCUMENTS

| | | | | |
|---|---|---|---|---|
| 2008/0068632 | A1* | 3/2008 | Fukasawa | 358/1.12 |
| 2009/0220289 | A1* | 9/2009 | Marsh | 399/364 |
| 2010/0301549 | A1* | 12/2010 | Moriyama | 271/264 |
| 2012/0134732 | A1 | 5/2012 | Okano et al. | |
| 2012/0161387 | A1* | 6/2012 | Horade | 271/225 |

FOREIGN PATENT DOCUMENTS

| | | | |
|---|---|---|---|
| JP | 2001293858 | A * | 10/2001 |
| JP | 2012-118142 | | 6/2012 |
| JP | 2012-240813 | | 12/2012 |

* cited by examiner

*Primary Examiner* — Julian Huffman
*Assistant Examiner* — Sharon A Polk
(74) *Attorney, Agent, or Firm* — Workman Nydegger

(57) ABSTRACT

A recording apparatus includes a recording head that performs recording on a medium; a first roller that inverts the medium which is fed from a side of the recording head; and a second roller of which an outer circumferential surface is in contact with medium transportation paths before and after the medium is inverted by the first roller and which exerts a transportation force on the medium.

22 Claims, 15 Drawing Sheets

RECORDING APPARATUS

BACKGROUND

1. Technical Field

The present invention relates to a recording apparatus that is represented by a facsimile, a printer or the like.

2. Related Art

In a recording apparatus that is represented by a facsimile, a printer or the like, there is also the recording apparatus that can perform recording on both surfaces of recording paper as an example of a medium. For example, as illustrated in JP-A-2012-240813, the recording apparatus has an inverted path in which the recording paper is inverted. The recording apparatus performs recording on a first surface (a front surface) of the recording paper, feeds the recording paper backward to the inverted path, and transports the recording paper again to a region that faces a recording head while a second surface (a back surface) thereof faces upward.

In the recording apparatus according to JP-A-2012-240813, an outer circumferential surface of one roller (hereinafter, referred to as "inversion roller") is used to form the inverted path. Accordingly, in this configuration, there is a problem in that when the apparatus is designed on the basis that paper of a large size is used, it is necessary to make the inversion roller large, and the size of the apparatus becomes large.

In contrast, the apparatus may also have a configuration in which the inverted path is not formed by the outer circumferential surface of the inversion roller but by a guide member, and transportation rollers are disposed at multiple locations. However, in this case, there is a problem in that the number of the disposed transportation rollers is likely to increase, and the number of components increases.

A printing apparatus according to JP-A-2012-118142 adopts a configuration in which a printing path for duplex printing is disposed on a lower side of a printing mechanism, printed paper is fed to the lower side of the printing mechanism, and is returned to a printing region again. However, in this configuration, there is a problem in that a dimension in a height direction of the apparatus becomes large.

SUMMARY

An advantage of some aspects of the invention is to provide a recording apparatus that can ensure the length of an inverted path to perform recording on both surfaces of a medium while suppressing the dimension of the apparatus.

A recording apparatus according to an aspect of the invention includes a recording head that performs recording on a medium; a first roller that inverts the medium which is fed from a side of the recording head by using an outer circumferential surface thereof; and a second roller of which an outer circumferential surface is in contact with medium transportation paths before and after the medium is inverted by the first roller and which exerts a transportation force on the medium.

According the aspect, since an inverted path for inverting the medium includes the first roller that inverts the medium by using the outer circumferential surface thereof, and the second roller of which the outer circumferential surface is in contact with the medium transportation paths before and after the medium is inverted by the first roller and which exerts the transportation force on the medium, the diameter of the first roller may be prevented from becoming large, and it may be ensured that the inverted path has the length enough for the second roller to invert the medium.

Since the second roller is in contact with the medium transportation paths before and after the medium is inverted by the first roller and which exerts the transportation force on the medium, one roller (the second roller) contributes to formation of the medium transportation paths before and after the medium is inverted by the first roller and thus, the number of the rollers that are disposed may be reduced, and an increase in cost may be suppressed.

In the recording apparatus according to the aspect of the invention, the first and the second rollers may be provided at the same position in a height direction of the apparatus.

According to the aspect, since the first and the second rollers are provided at the same position in the height direction of the apparatus, dimensions of disposition regions of the first and the second rollers may be limited to the minimum in the height direction of the apparatus.

In the recording apparatus according to the aspect of the invention, the first and the second rollers may be provided at the same position as a position of a disposition region of the recording head in the height direction of the apparatus.

According to the aspect, since the first and the second rollers are provided at the same position as the position of the disposition region of the recording head in the height direction of the apparatus, the disposition region of the recording head may be prevented from overlapping the disposition regions of the first and the second rollers in the height direction of the apparatus. The increase of the dimension in the height direction of the apparatus may be suppressed.

In the recording apparatus according to the aspect of the invention, the first and the second rollers may have the same diameter.

According to the aspect, since the first and the second rollers have the same diameter, the first and the second rollers may be made of a common configuration member, and low costs may be achieved. Circumferential velocities of the outer circumferences of the rollers, that is, medium transportation velocities may be equal to each other when the numbers of rotations of both rollers are set to be the same.

In the recording apparatus according to the aspect of the invention, the first and the second rollers may have the same medium transportation velocity.

According to the aspect, since the first and the second rollers have the same medium transportation velocity, tension or deflection is not exerted on the medium between the first and the second rollers. As a result, the medium may be reliably transported.

In the recording apparatus according to the aspect of the invention, the first and the second rollers may be driven by a common driving source.

According to the aspect, since the first and the second rollers are driven by a common driving source, an increase in costs of driving means of the first and the second rollers may be suppressed.

In the recording apparatus according to the aspect of the invention, a plurality of the second rollers may be provided in a medium width direction that intersects with a medium transportation direction.

According to the aspect, since the plurality of second rollers are provided in the medium width direction that intersects with the medium transportation direction, the medium is in contact with the second roller at multiple positions in the width direction of the medium and thus, oblique feeding of the medium may be suppressed during the transportation thereof.

In the recording apparatus according to the aspect of the invention, the first and the second rollers may be provided with a plurality of driven rollers along the medium transportation path before the inversion of the medium and the medium transportation path after the inversion of the medium.

According to the aspect, since the first and the second rollers are provided with the plurality of driven rollers along the medium transportation paths, the medium can be smoothly transported.

The recording apparatus according to the aspect of the invention may further include a first driven roller that is rotationally driven while the medium is nipped between the second roller and the first driven roller; and a second driven roller that is provided on an upstream side of the first driven roller in the medium transportation direction, and is rotationally driven while the medium is nipped between the second roller and the second driven roller.

According to the aspect, since the medium is nipped by the plurality of driven rollers (the first driven roller and the second driven roller) of the second roller, oblique feeding of the medium may be reliably suppressed during the transportation thereof.

The recording apparatus according to the aspect of the invention may further include a third driven roller that is rotationally driven while the medium is nipped between the first roller and the third driven roller.

According to the aspect, since the recording apparatus further includes the third driven roller that is rotationally driven while the medium is nipped between the first roller and the third driven roller, the plurality of driven rollers, that is, the first to the third driven rollers can reliably suppress oblique feeding of the medium during the transportation thereof.

In the recording apparatus according to the aspect of the invention, the first driven roller may be positioned above a center shaft of the second roller in the height direction of the apparatus, and on a front side of the apparatus in a front and back direction of the apparatus.

According to the aspect, the medium may be sent from the second roller toward the recording head in a natural posture and without difficulty.

The recording apparatus according to the aspect of the invention may further include a fourth driven roller that is rotationally driven while the medium fed from the recording head toward the first roller is nipped between the second roller and the fourth driven roller.

According to the aspect, since the fourth driven roller transports the medium fed from the recording head toward the first roller to the first roller while the medium is nipped between the second roller and the fourth driven roller, the medium may be smoothly inverted in the first roller.

The recording apparatus according to the aspect of the invention may further include a medium container that can contain a plurality of the mediums. A feeding path of the medium fed from the medium container converges with the medium transportation path formed by the first roller.

According to the aspect, since the feeding path of the medium, which is fed from the medium container that can contain the plurality of mediums, converges with the medium transportation path formed by the first roller, that is, the first roller forms not only the inverted path but also the non-inverted path, space saving may be achieved and the number of components may be reduced.

The recording apparatus according to the aspect of the invention may further include a medium support tray that supports the medium that is not yet fed. A supply path of the medium supplied via the medium support tray converges with the medium transportation path formed by the first roller.

According to the aspect, since the recording apparatus includes the medium support tray that supports the medium that is not yet fed, and the supply path of the medium supplied via the medium support tray converges with the medium transportation path formed by the first roller, that is, the first roller also forms the supply path of the medium from the medium support tray, space saving may be achieved and the number of components may be reduced.

In addition, since the second roller is positioned downstream of the first roller, the length (the length of a path of up to a recording region) of the supply path of the medium supplied via the medium support tray may be ensured. Accordingly, the following operation effect is obtained as an example. For example, when a user manually supplies the medium via the medium support tray, there is a problem in that the user inserts the medium into the apparatus deep enough to significantly exceed a recommended setting position. At this time, if a leading edge of the medium reaches a position that faces the recording head, the recording head cannot properly perform recording on the medium. However, as described above, since the length of the supply path of the medium supplied via the medium support tray may be ensured, the problem may be prevented from occurring.

In the recording apparatus according to the aspect of the invention, a unit body that is attachable and detachable with respect to a recording apparatus main body is configured to have the first and the second rollers.

According to the aspect, since the unit body that is attachable and detachable with respect to the recording apparatus main body is configured to have the first and the second rollers, when the unit body is detached from the recording apparatus main body, the inverted path of the medium is exposed. Accordingly, when the medium is jammed (when a paper jam occurs), the jammed medium may be easily removed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In each of the embodiments, the same reference signs will be assigned to the same configurations. The configurations will be described only in a first embodiment, and will not be described in another embodiment.

Figure 1:
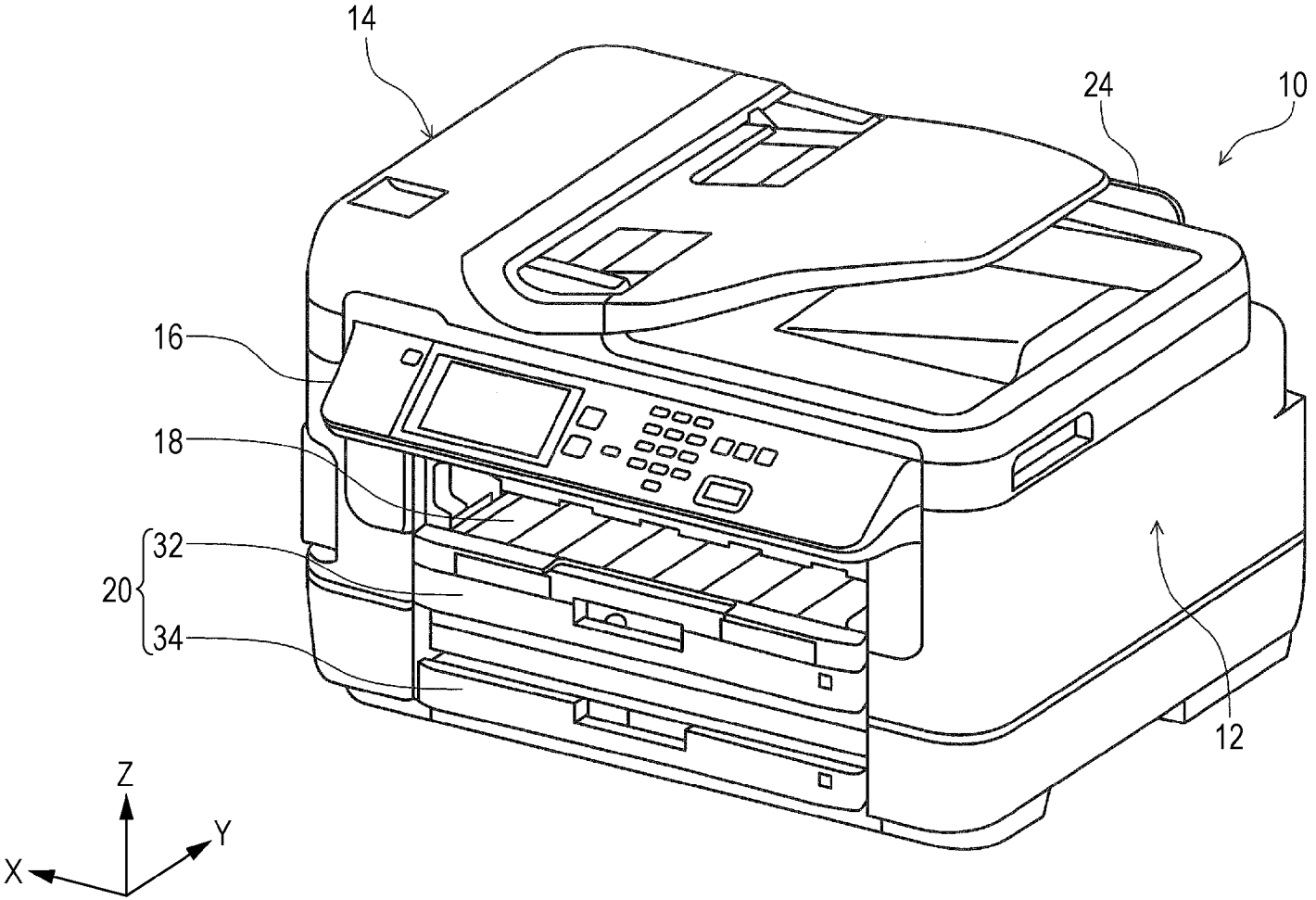
FIG. 1 is a perspective view of a printer according to the invention.
Figure 2:
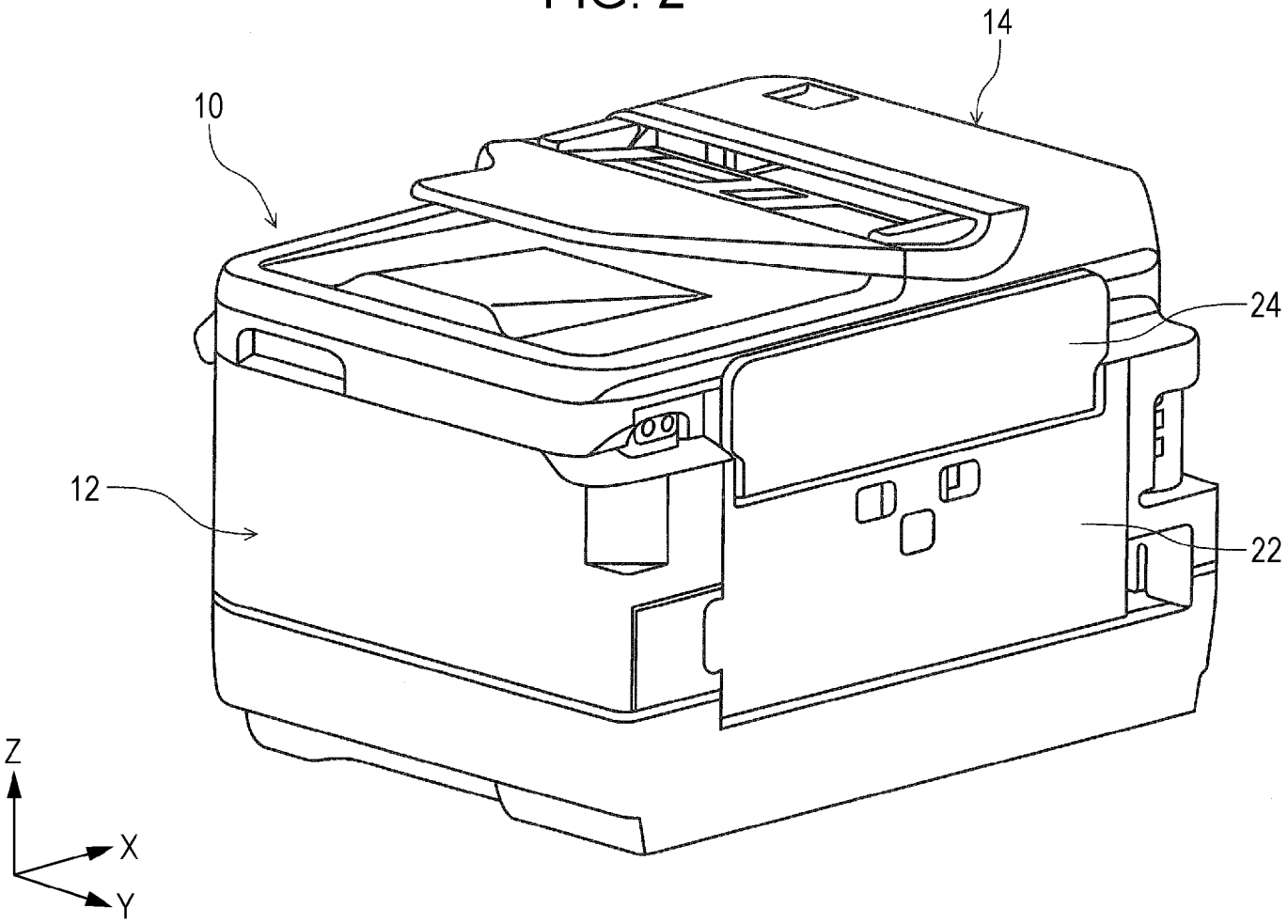
FIG. 2 is a rear perspective view of the printer according to the invention.
Figure 3:
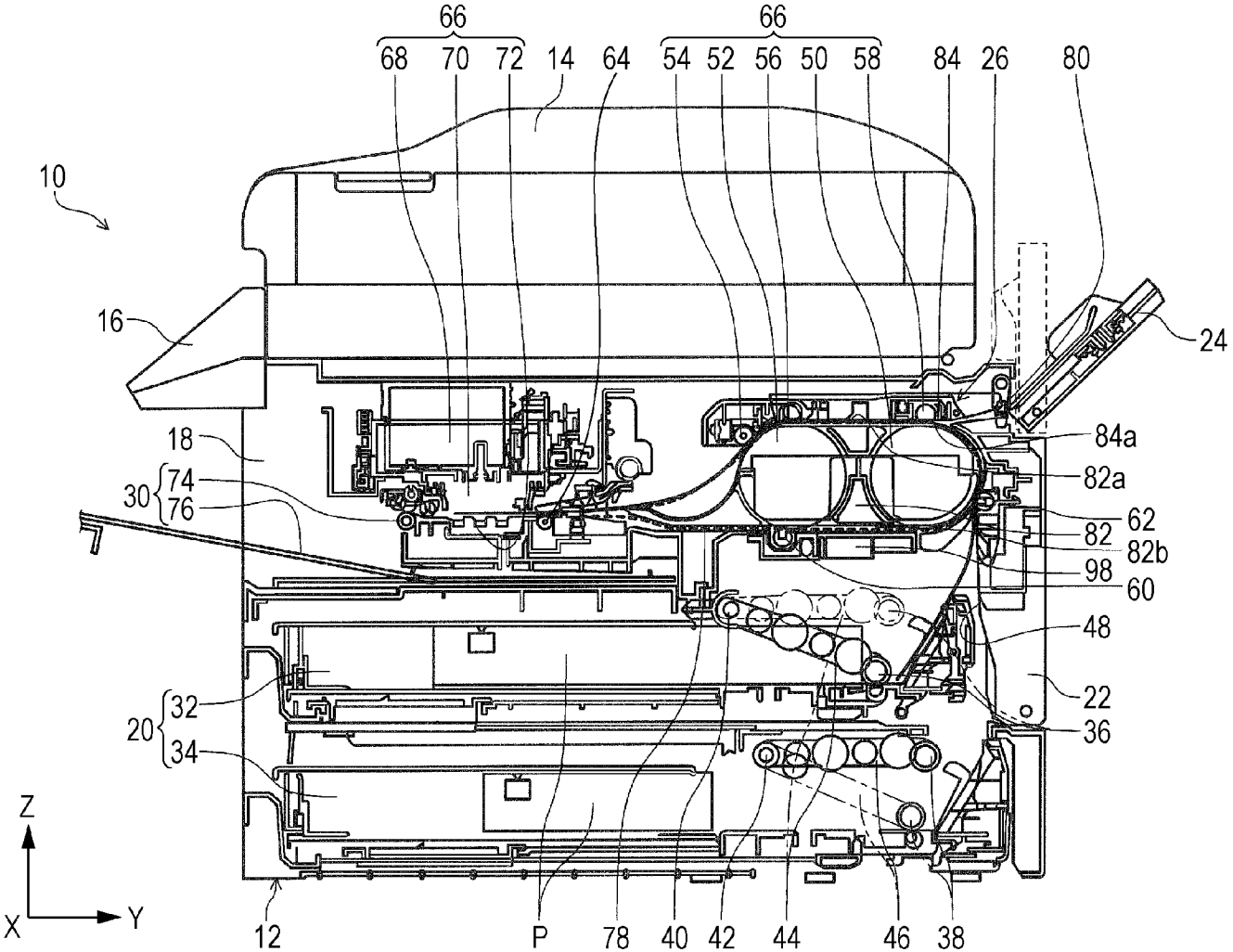
FIG. 3 is a cross-sectional side view illustrating a paper transportation path of the printer according to the invention.
Figure 4:
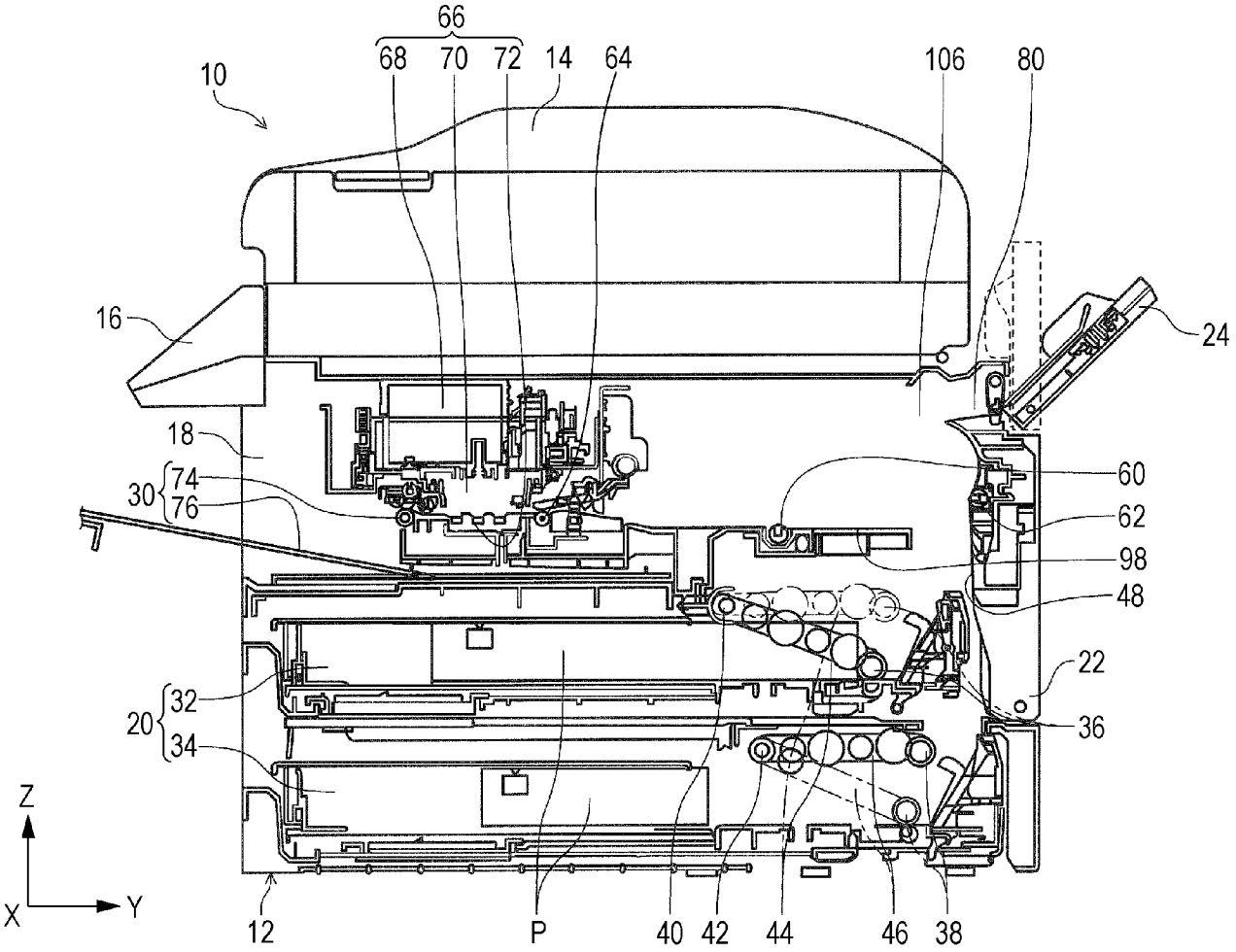
FIG. 4 is a cross-sectional side view illustrating a state where a transportation unit is detached from the paper transportation path of the printer according to the invention.
Figure 5:
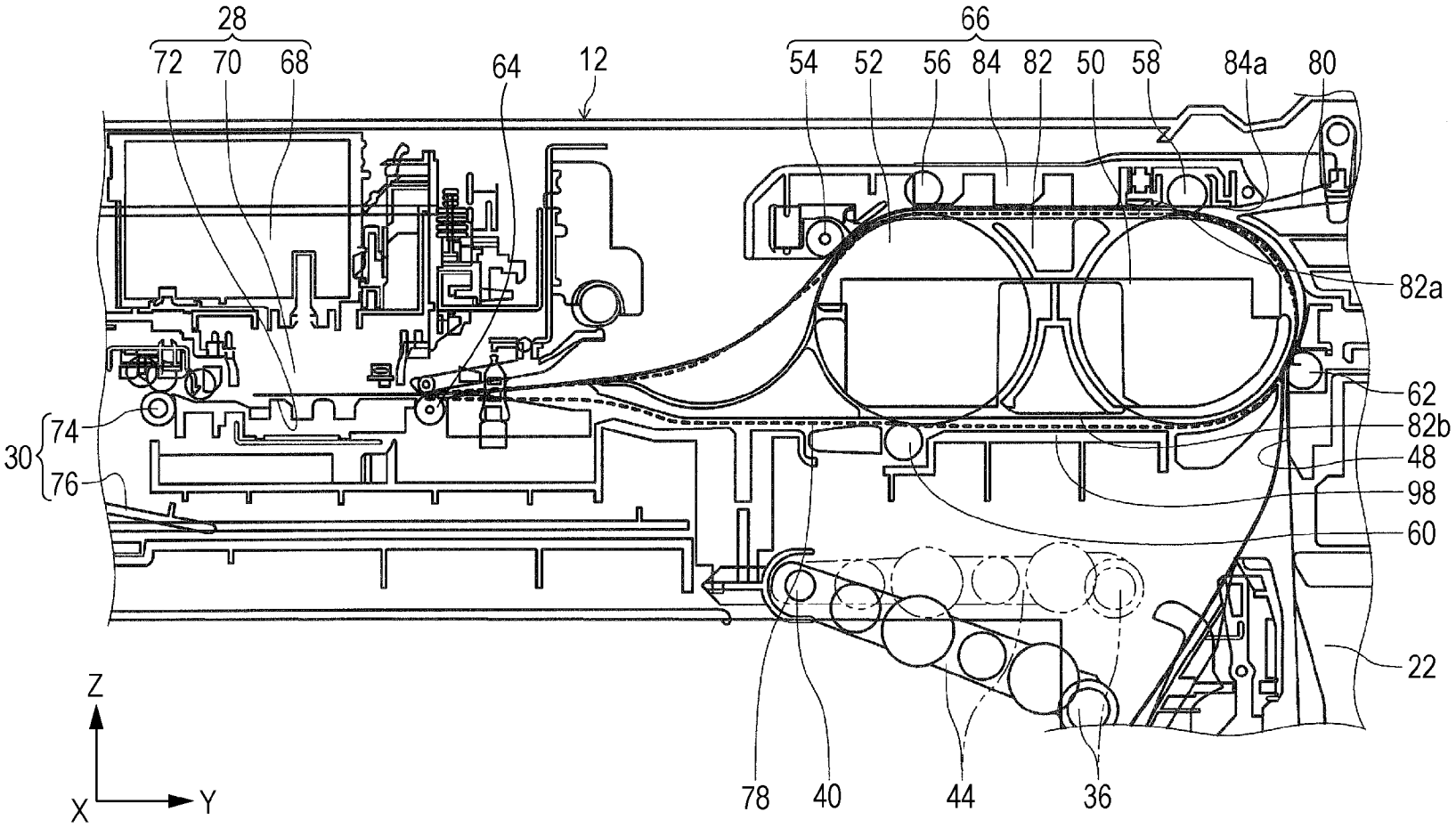
FIG. 5 is an enlarged view illustrating the vicinity of the transportation section in the paper transportation path of the printer according to the invention.
Figure 6:
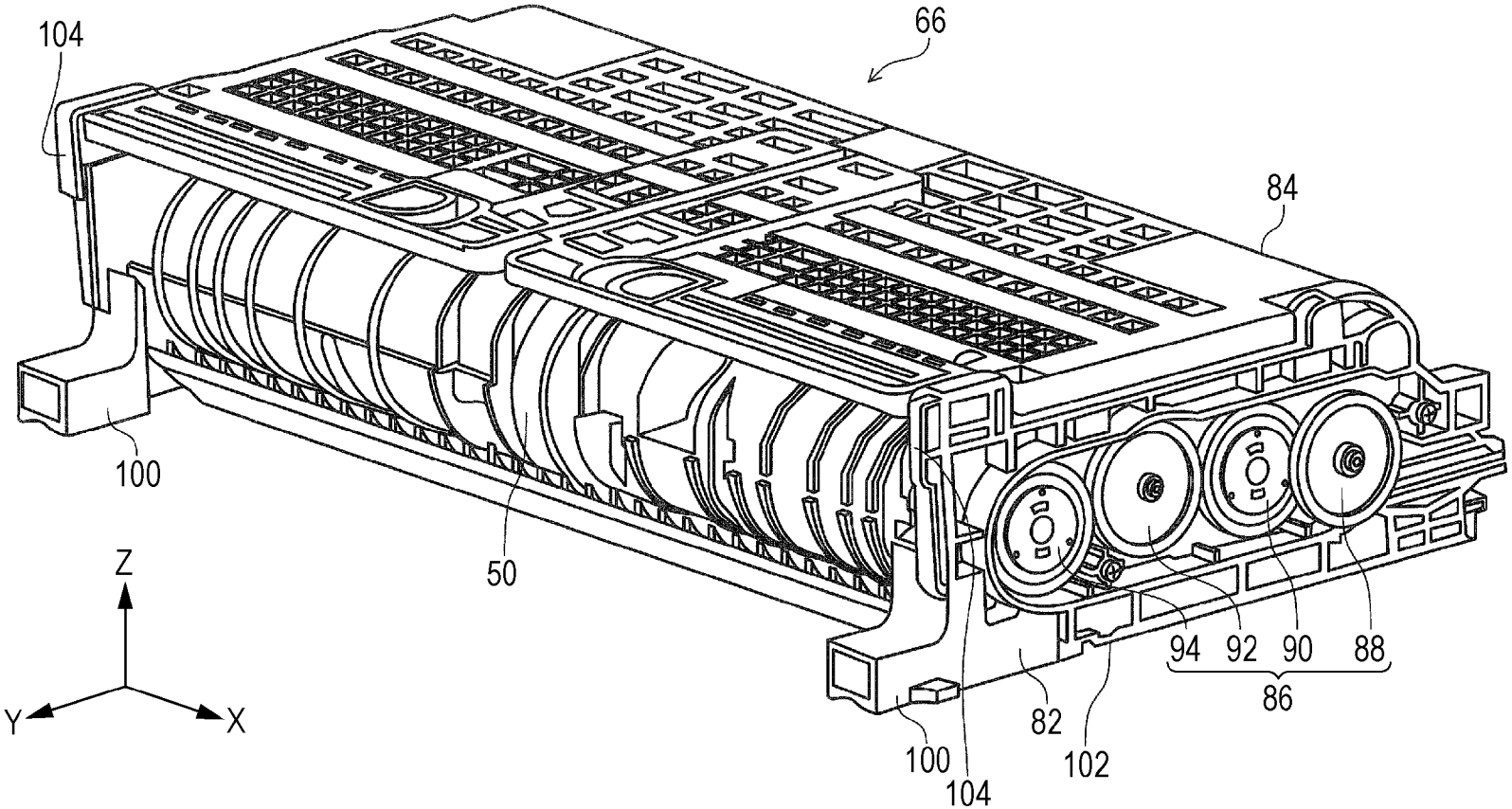
FIG. 6 is a perspective view of the transportation unit according to the invention.
Figure 7A:
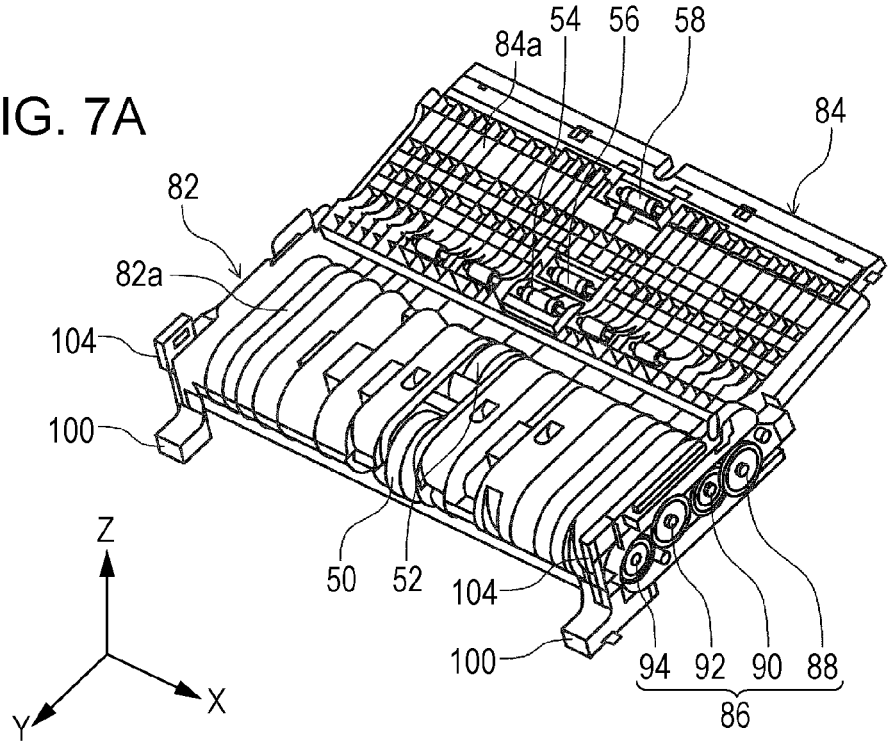
FIG. 7A is a perspective view illustrating a state where the paper transportation path in the transportation unit is open.
Figure 7B:
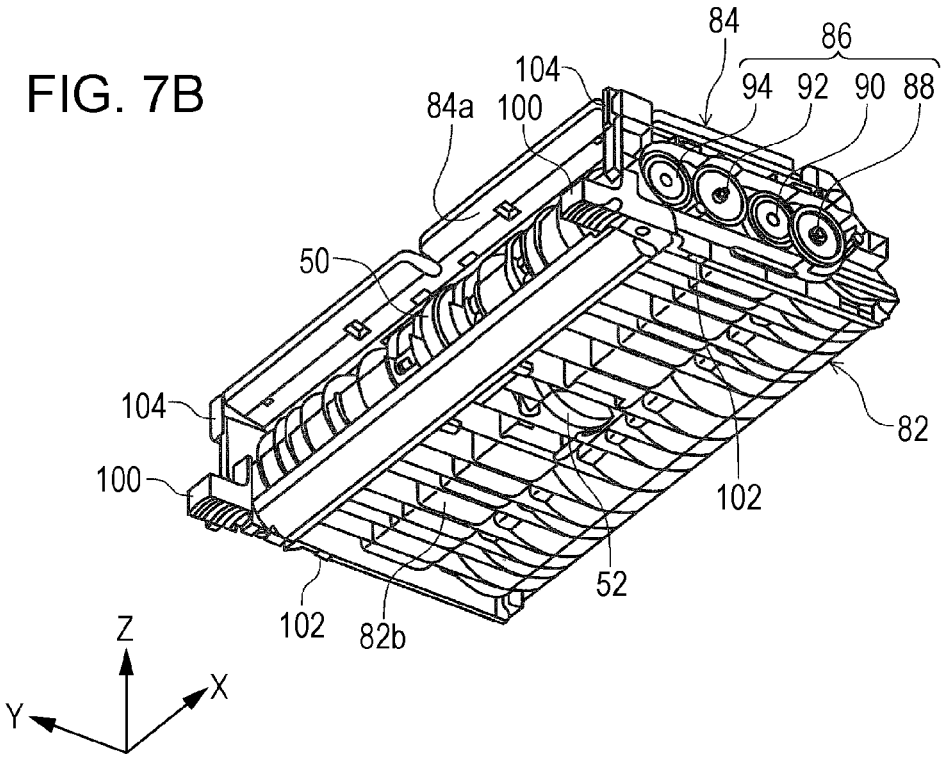
FIG. 7B is a perspective view when the transportation unit is seen from below.

FIG. 1 is a perspective view of a printer according to the invention. FIG. 2 is a rear perspective view of the printer according to the invention. FIG. 3 is a cross-sectional side view illustrating a paper transportation path of the printer according to the invention. FIG. 4 is a cross-sectional side view illustrating a state where a transportation unit is detached from the paper transportation path of the printer according to the invention. FIG. 5 is an enlarged view illustrating the vicinity of the transportation section in the paper transportation path of the printer according to the invention. FIG. 6 is a perspective view of the transportation unit according to the invention. FIG. 7A is a perspective view illustrating a state where the paper transportation path in the transportation unit is open. FIG. 7B is a perspective view when the transportation unit is seen from below.

Figure 8:
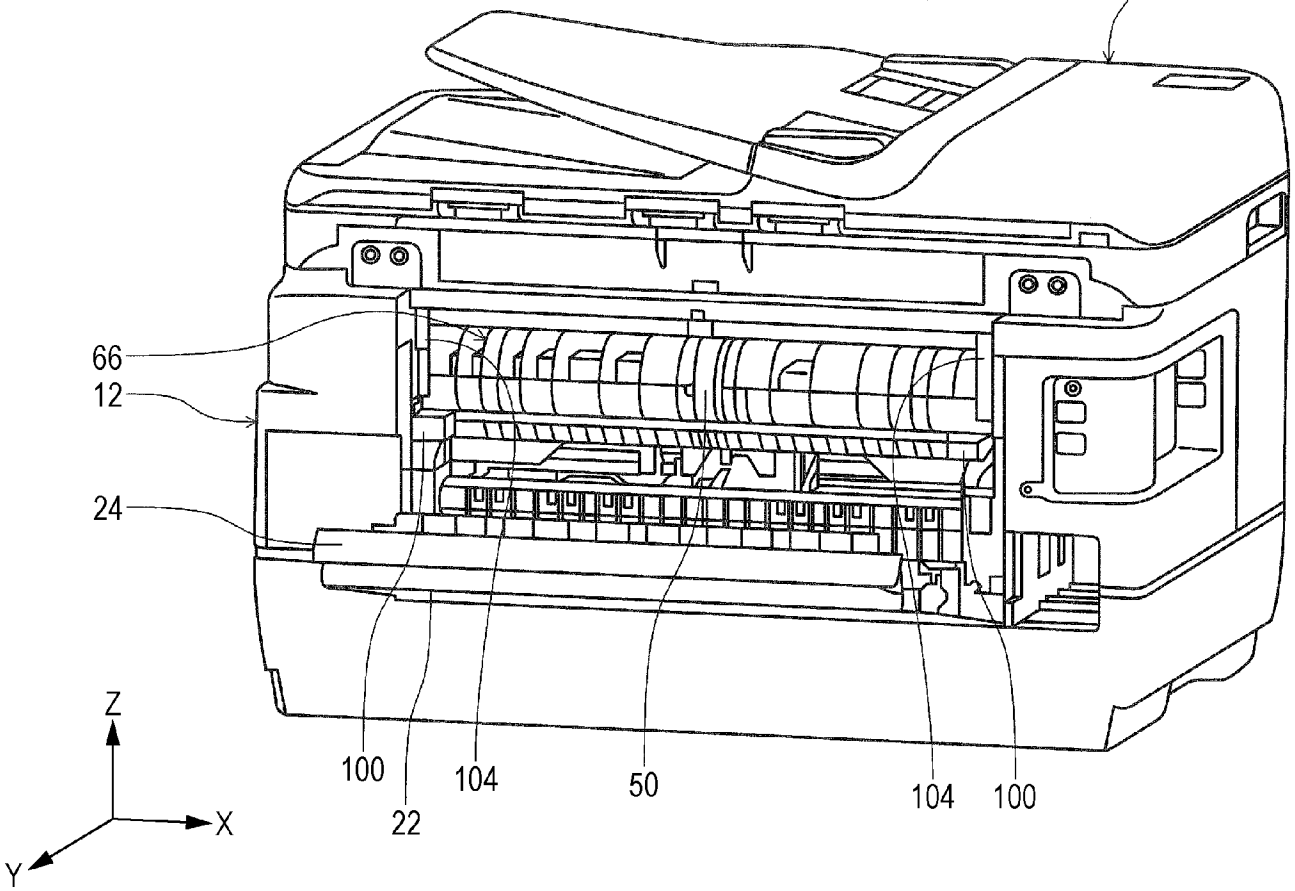
FIG. 8 is a rear perspective view illustrating a state where a back surface cover of the printer according to the invention is open.
Figure 9A:
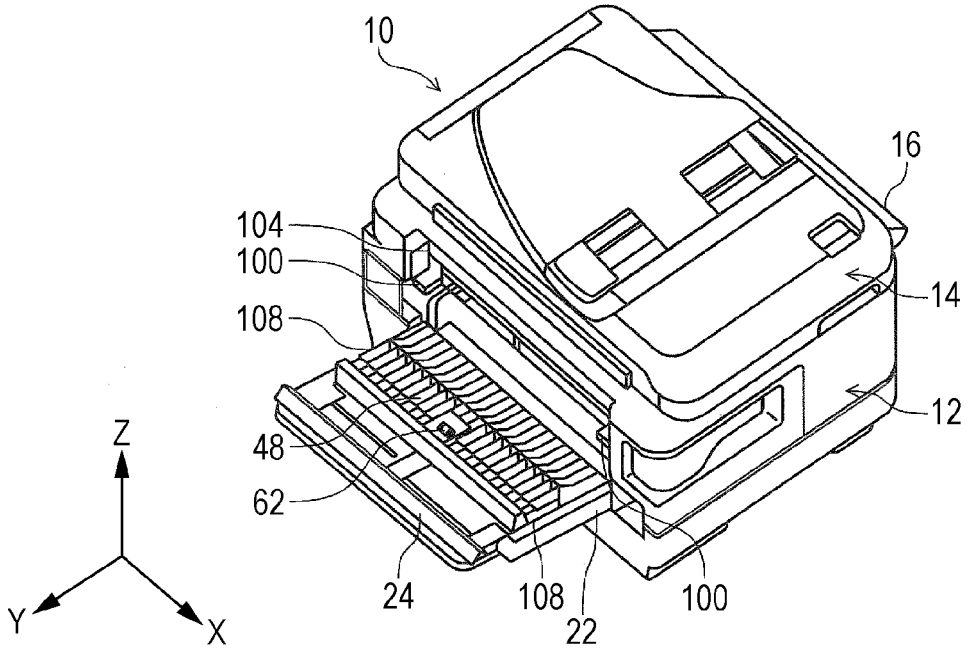
FIG. 9A is a perspective view when the printer according to the invention is seen from above in a state where the back surface cover is open.
Figure 9B:
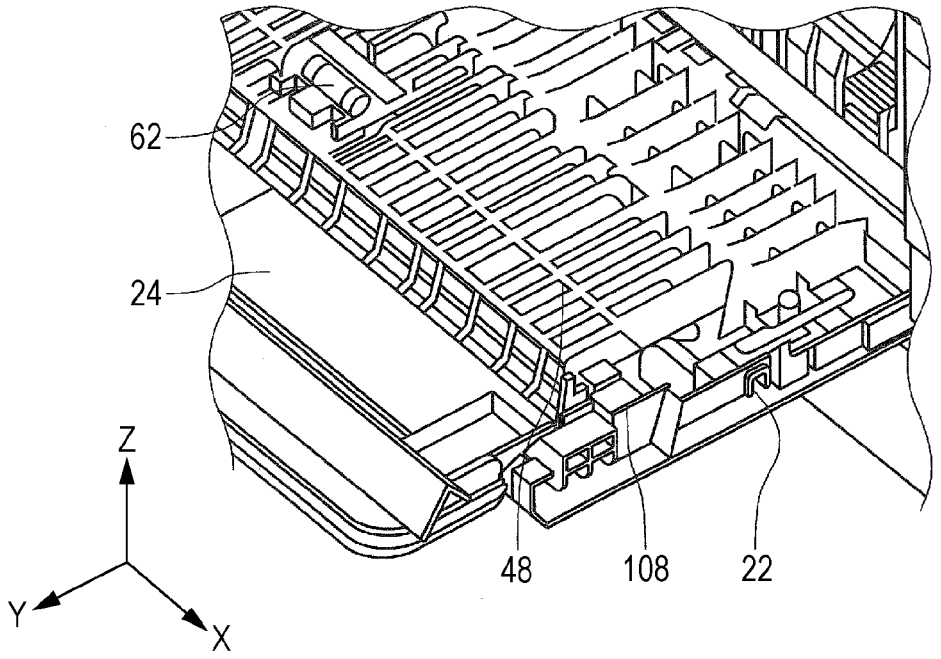
FIG. 9B is an enlarged view of the back surface cover in FIG. 9A.
Figure 10A:
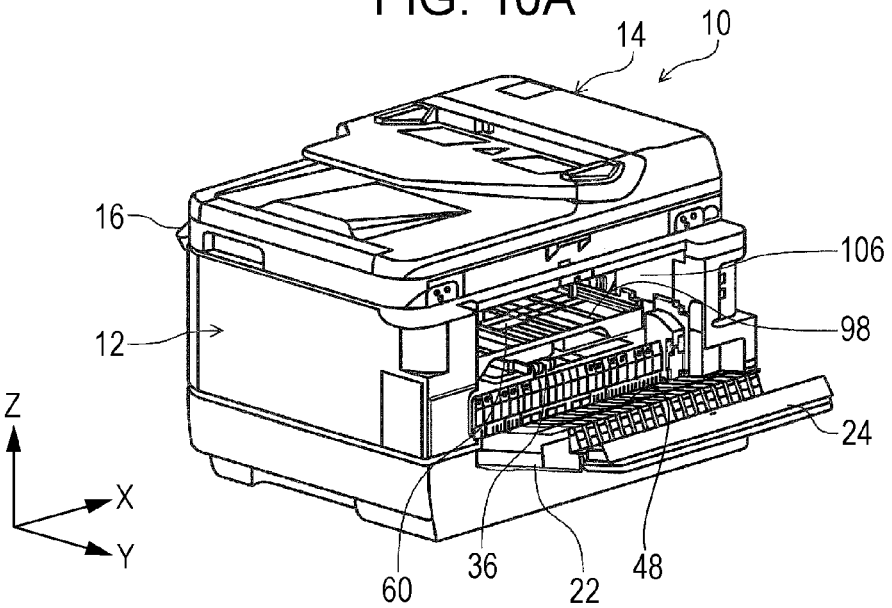
FIG. 10A is a rear perspective view illustrating a state where the transportation unit is detached from the printer.
Figure 10B:
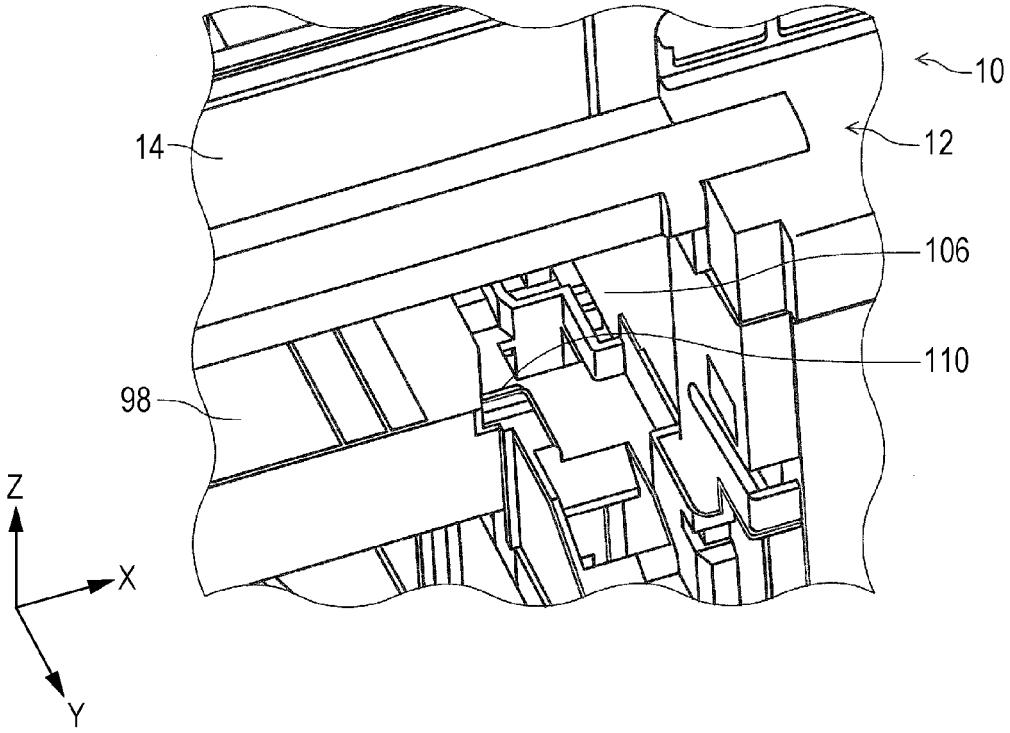
FIG. 10B is an enlarged perspective view illustrating a stopper section provided on the printer.
Figure 11A:
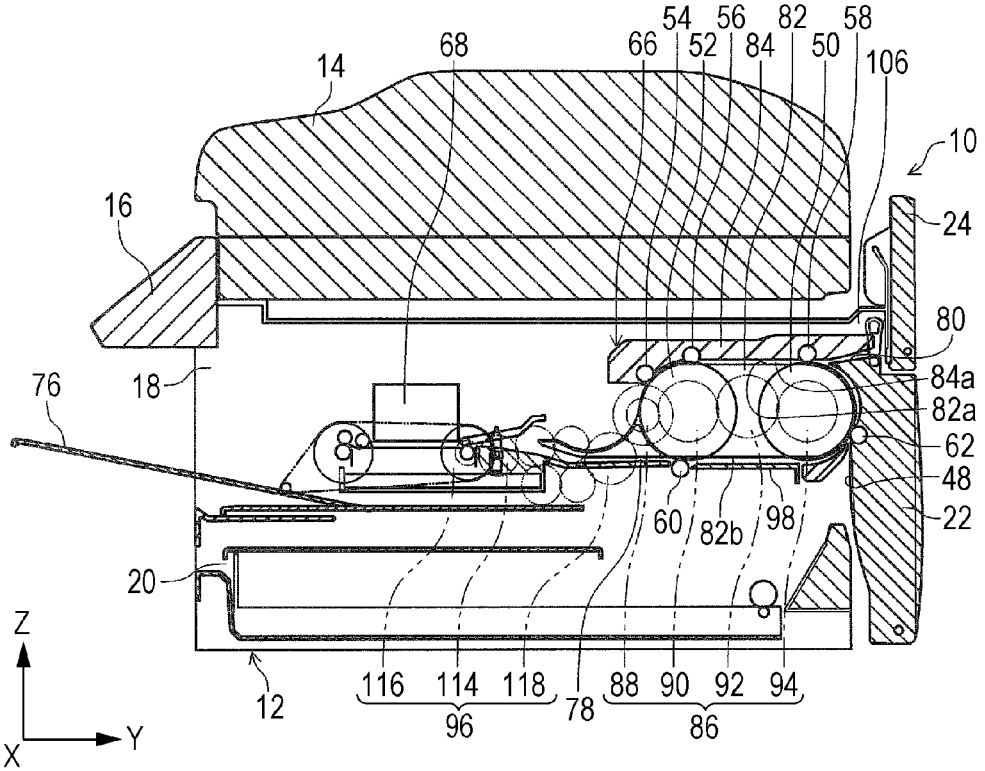
FIG. 11A is a view illustrating a power transmission path of the transportation unit according to the invention.
Figure 11B:
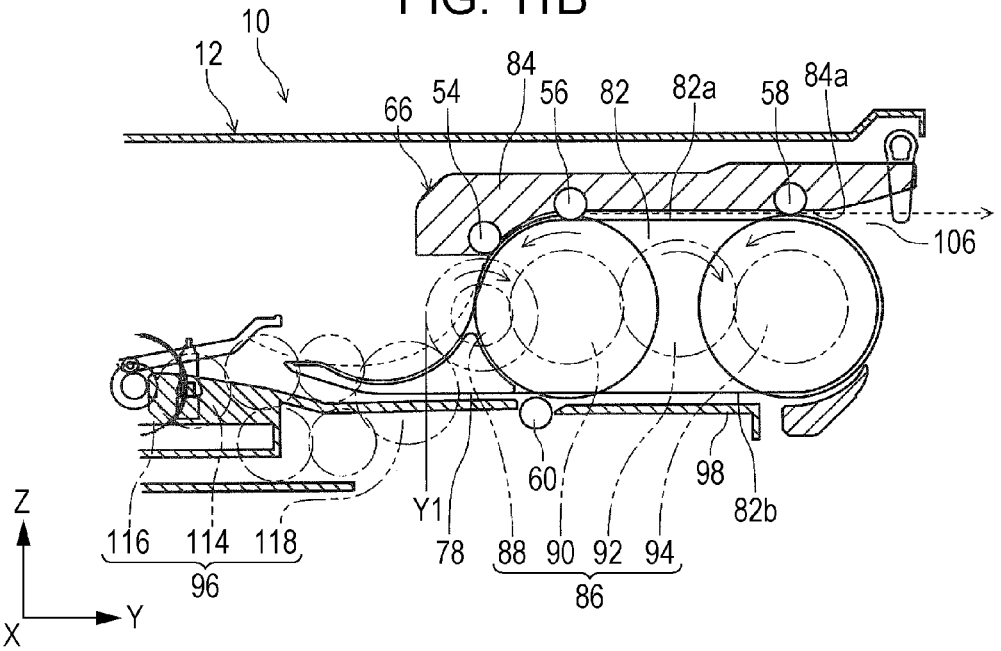
FIG. 11B is an enlarged view of the transportation unit in FIG. 11A.

FIG. 8 is a rear perspective view illustrating a state where a back surface cover of the printer according to the invention is open. FIG. 9A is a perspective view when the printer according to the invention is seen from above in a state where the back surface cover is open. FIG. 9B is an enlarged view of the back surface cover in FIG. 9A. FIG. 10A is a rear perspective view illustrating a state where the transportation unit is detached from the printer. FIG. 10B is an enlarged perspective view illustrating a stopper section provided on the printer. FIG. 11A is a view illustrating a power transmission path of the transportation unit according to the invention. FIG. 11B is an enlarged view of the transportation unit in FIG. 11A.

Figure 12A:
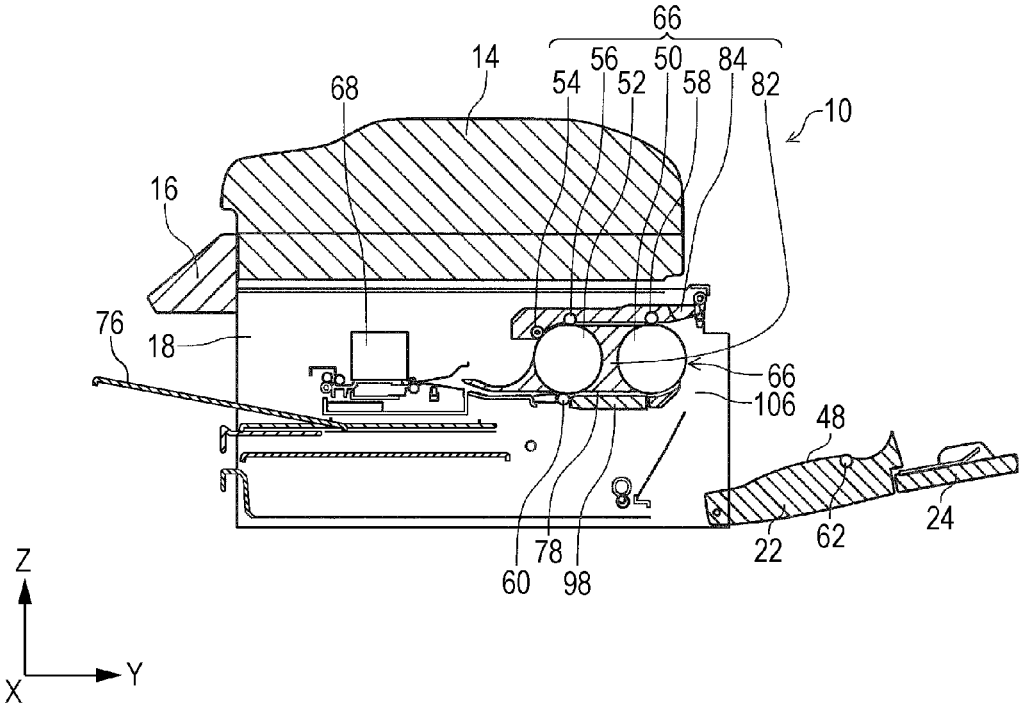
FIG. 12A is a cross-sectional side view illustrating a state where the back surface cover of the printer according to the invention is open.
Figure 12B:
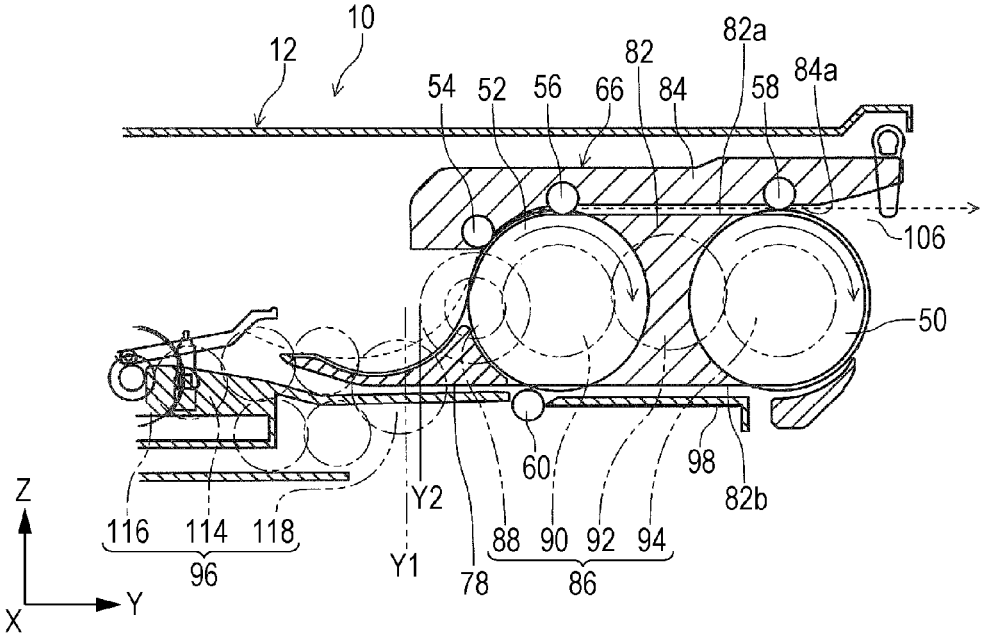
FIG. 12B is a cross-sectional side view illustrating a state where power transmission in the power transmission path of the transportation unit is disconnected.
Figure 13A:
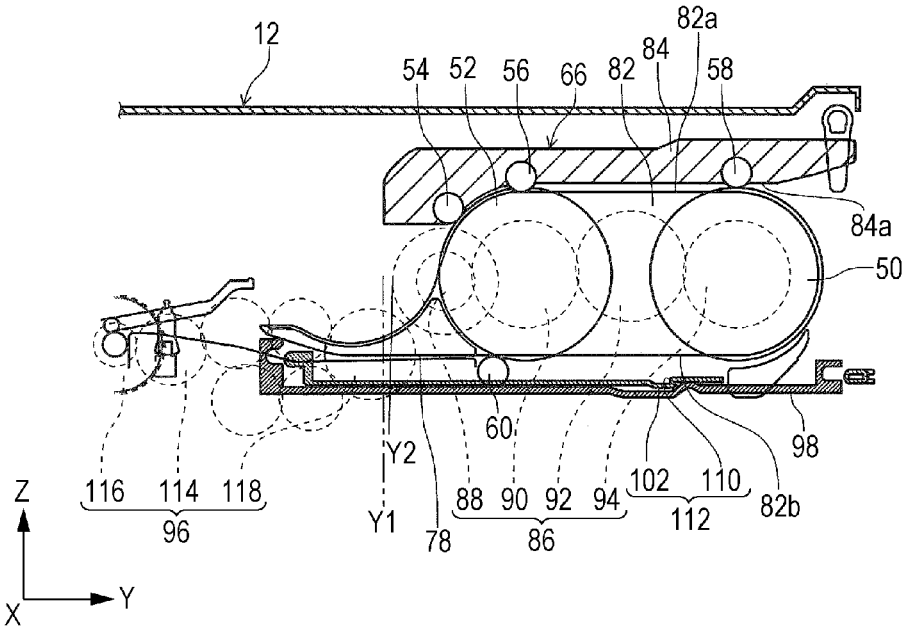
FIG. 13A is a cross-sectional side view illustrating states of the transportation unit and the stopper section of the printer in FIG. 12B.
Figure 13B:
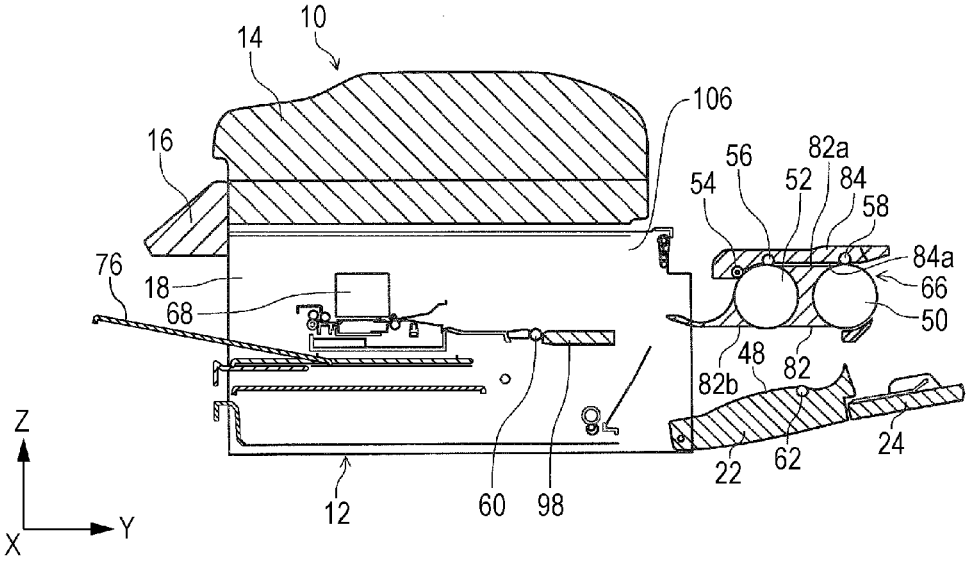
FIG. 13B is a cross-sectional side view illustrating a state where the transportation unit is detached from the printer.
Figure 14:
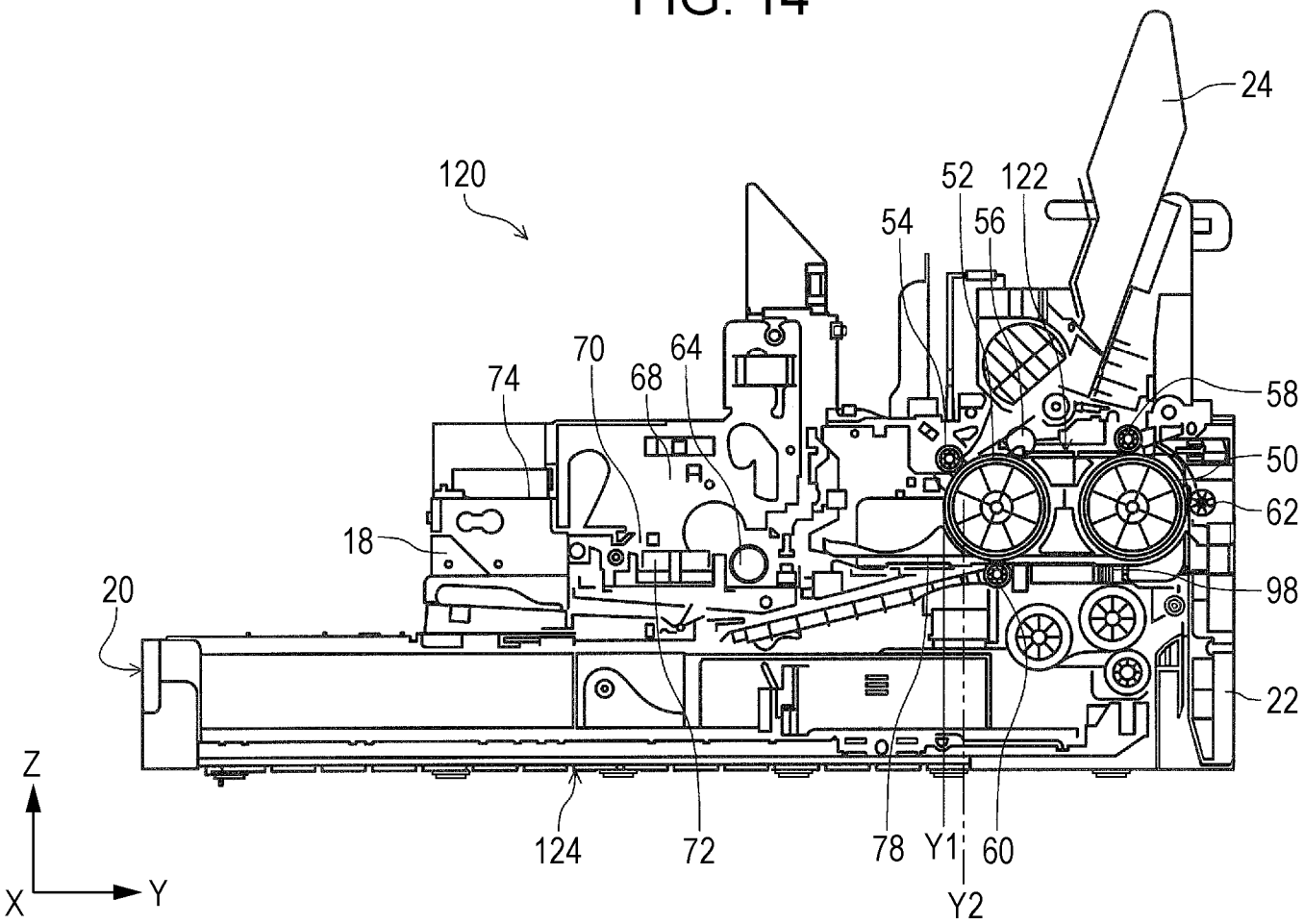
FIG. 14 is a cross-sectional side view of a printer to which a transportation unit of a second embodiment is attached.
Figure 15:
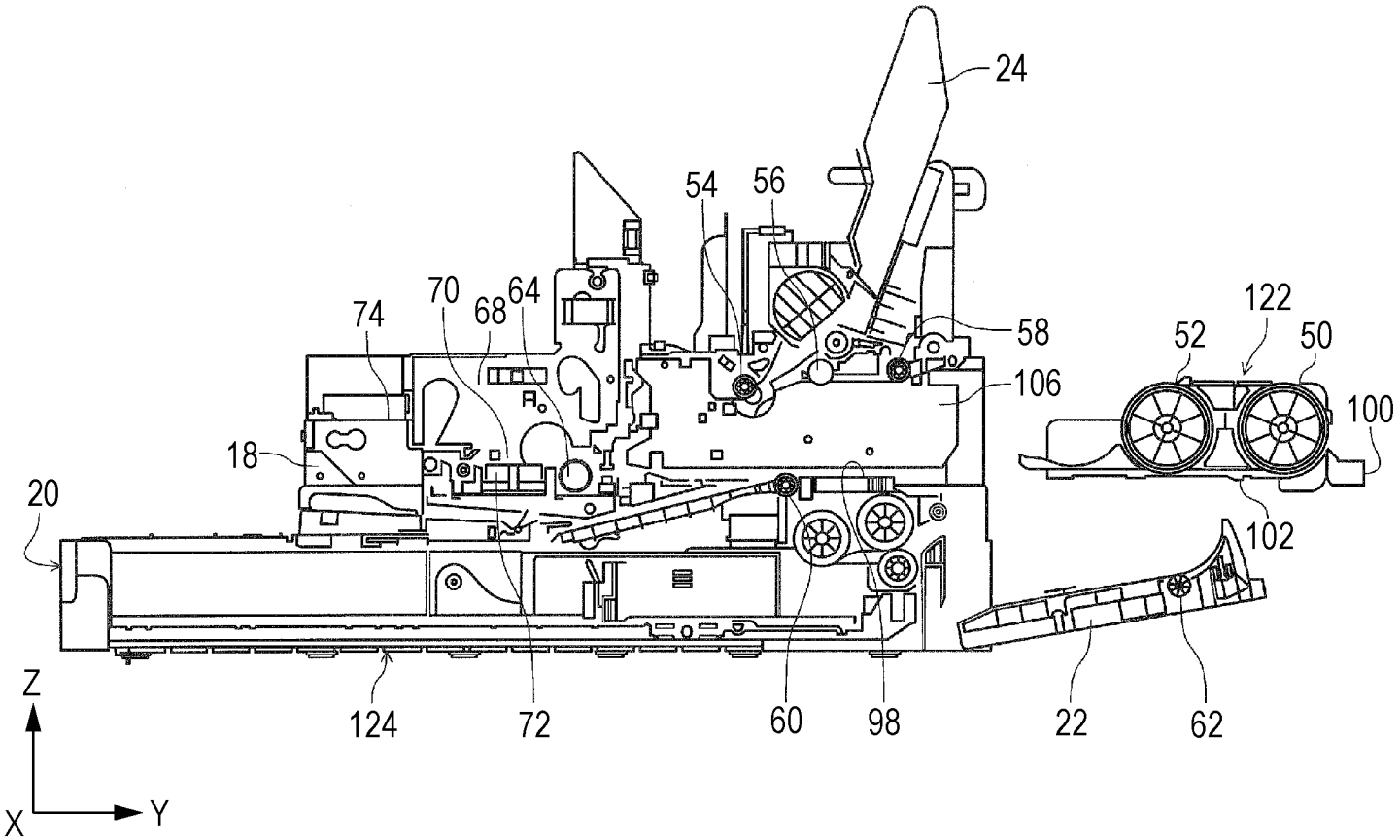
FIG. 15 is a cross-sectional side view of the printer from which the transportation unit of the second embodiment is detached.

FIG. 12A is a cross-sectional side view illustrating a state where the back surface cover of the printer according to the invention is open. FIG. 12B is a cross-sectional side view illustrating a state where power transmission in the power transmission path of the transportation unit is disconnected. FIG. 13A is a cross-sectional side view illustrating states of the transportation unit and the stopper section of the printer in FIG. 12B. FIG. 13B is a cross-sectional side view illustrating a state where the transportation unit is detached from the printer. FIG. 14 is a cross-sectional side view of a printer to which a transportation unit of a second embodiment is attached. FIG. 15 is a cross-sectional side view of the printer from which the transportation unit of the second embodiment is detached.

In FIGS. 3 and 4, substantially all rollers are drawn on the same drawing sheet to illustrate the rollers disposed in the paper transportation path of a printer 10. However, the rollers are not always coincidentally positioned in a depth direction (in a front and back direction of a drawing sheet in a FIG. 3) of the printer 10 (some rollers are coincidentally positioned in the depth direction thereof). In an X, Y and Z coordinate system of each drawing, an X direction indicates a scanning direction of a recording head, a Y direction indicates a depth direction of a recording apparatus, and a Z direction indicates a height direction of the printer. In each drawing, a −Y direction indicates a front surface side of the apparatus, and a +Y direction indicates a back surface side thereof.

Outline of Printer

FIGS. 1 and 2 illustrate the printer 10 according to the invention. The printer 10 includes an apparatus main body 12, and a manuscript scanning apparatus 14 that is provided on an upper portion of the apparatus main body 12 to be rotationally movable with respect to the apparatus main body 12. The apparatus main body 12 includes an operation panel section 16 which is provided on the front surface side (on a side of the −Y direction in FIG. 1) of the apparatus, and through which a user operates the printer 10; a discharge port 18 that is open toward the front surface side of the apparatus; and medium containers 20 that are disposed under the discharge port 18.

The apparatus main body 12 includes a back surface cover 22 on the back surface side (on a side of the +Y direction in FIG. 2) of the apparatus as an opening/closing body that is configured to be rotationally movable with respect to the apparatus main body 12. In FIG. 2, the back surface cover 22 is closed with respect to the apparatus main body 12. The back surface cover 22 includes a medium support tray 24 that is rotationally movable with respect to the back surface cover 22 and is connected to a side opposite to a rotationally moving shaft thereof to be described later, that is, a free end side of the back surface cover 22.

Subsequently, in the printer 10, a transportation path of paper P as a "medium" will be described with reference to FIGS. 3 and 5. The printer 10 includes a medium container 20, a transportation section 26, a recording section 28 and a discharge section 30 in the apparatus main body 12.

The medium container 20 includes an upper stage tray 32 that is positioned on an upper side in the Z direction, and a lower stage tray 34 that is positioned below the upper stage tray 32. The upper stage tray 32 and the lower stage tray 34 are configured in such a manner that the upper stage tray 32 and the lower stage tray 34 can be mounted onto and detached from the apparatus main body 12 from a front side (the −Y direction in FIG. 3) of the apparatus.

Each of the upper stage tray 32 and the lower stage tray 34 contains a plurality of the paper P. In the embodiment, each of the upper stage tray 32 and the lower stage tray 34 contains a different type of paper, but in a case where it is not particularly necessary to distinguish the types of the paper from each other, the paper is referred to as the "paper P". The paper P is an example of the medium.

Pickup rollers 36 and 38 that are rotationally driven by driving sources which are not illustrated are respectively provided above the upper stage tray 32 and the lower stage tray 34. The pickup rollers 36 and 38 are respectively provided on rocking members 44 and 46 that respectively rock about rocking shafts 40 and 42.

When the paper P contained in the upper stage tray 32 is fed to a downstream side of the transportation path based on an instruction input from the operation panel section 16, a PC or the like, the pickup roller 36 rotates in contact with the uppermost paper P contained in the upper stage tray 32 and thus, the uppermost paper P is fed from the upper stage tray 32 to the downstream side of the transportation path. Similarly, when the paper P contained in the lower stage tray 34 is fed to the downstream side of the transportation path, the pickup roller 38 rotates in contact with the uppermost paper P contained in the lower stage tray 34 and thus, the uppermost paper P is fed from the lower stage tray 34 to the downstream side of the transportation path.

When the back surface cover 22 is closed with respect to the apparatus main body 12, an inner surface of the back surface cover 22 forms a part of the transportation path of the paper P. That is, a feeding path section 48 formed on an inside of the back surface cover 22 guides the paper P fed from the upper stage tray 32 and the lower stage tray 34 to the transportation section 26.

The transportation section 26 includes a first roller 50; a second roller 52; a first transportation driven roller 54 as a "first driven roller"; a second transportation driven roller 56 as a "second driven roller"; a third transportation driven roller 58 as a "third driven roller"; a fourth transportation driven roller 60; a fifth transportation driven roller 62; and a pair of transportation rollers 64.

Herein, a transportation unit 66 (refer to FIGS. 3, 4 and 6) that is attachable and detachable with respect to the apparatus main body 12 is configured to have the first roller 50, the second roller 52, the first transportation driven roller 54, the second transportation driven roller 56 and the third transportation driven roller 58. The transportation unit 66 as a "unit body" will be described later. In the embodiment, the first roller 50 and the second roller 52 are driven to rotate by a common drive motor 116 to be described later.

The transportation section 26 will be described later. The paper P is transported to the transportation rollers 64 via the fifth transportation driven roller 62 and the third transportation driven roller 58 which are in contact with the first roller 50 along the transportation path in the transportation section 26, and via the second transportation driven roller 56 and the first transportation driven roller 54 which are in contact with the second roller 52 along the transportation path in the transportation section 26. The recording section 28 is provided in the transportation path on a downstream side of the transportation rollers 64 of the transportation section 26.

The recording section 28 is provided in the transportation path on the downstream side of the transportation rollers 64 of the transportation section 26. The recording section 28 includes a carriage 68 that can move in the scanning direction (in the X axis direction in FIG. 3), a recording head 70 that is provided on a lower portion of the carriage 68 to eject ink on the paper P, and a platen 72 that is provided to face the recording head 70 and support the paper P.

The discharge section 30 is provided in the transportation path on the downstream side of the recording section 28. The discharge section 30 is provided with a pair of discharge rollers 74, and a discharge stacker 76 on which the paper P discharged from the discharge roller 74 is mounted and is provided on the front side (in the −Y direction) of the apparatus to protrude from the discharge port 18. When the paper P is fed from the transportation section 26 to the recording section 28 along the transportation path, recording is performed on a first surface of the paper P. After the recording is completed, the paper P is nipped by the discharge roller 74, and is discharged to the discharge stacker 76 that is provided on the front side of the apparatus.

When the recording section 28 performs recording on both surfaces of the paper P in the printer 10, the recording section 28 performs the recording on the first surface of the paper P, and then while a trailing edge of the paper when the recording is performed on the first surface becomes a leading edge thereof due to a backward feeding operation of the transportation rollers 64 and the discharge rollers 74, the paper P is fed to an inverted path 78 to be described later, which is positioned on a side further in a −Z direction than the second roller 52 in the Z axis direction, that is, which is positioned below the transportation unit 66. The inverted path 78 is provided below the first roller 50 and the second roller 52, that is, along the −Z direction in FIG. 3 and is provided to converge with the transportation path of the paper P from the medium container 20.

For this reason, the paper P is fed to the recording section 28 again via the transportation path from the inverted path 78 and a transportation path that is positioned above the first roller 50 and the second roller 52, and the recording section 28 performs recording on a second surface. After the recording is completed, the paper P is nipped by the discharge rollers 74, and is discharged to the discharge stacker 76 that is provided on the front side of the apparatus.

First Embodiment

Configuration of Transportation Section

Subsequently, the transportation section 26 will be described with reference to FIGS. 3 and 5. In FIG. 5, a solid line indicates the transportation path of the medium fed from the medium container 20, and a broken line indicates the inverted path of the paper P. The first roller 50 and the second roller 52 are provided at the same position in the Z axis direction in FIG. 3. For this reason, it is possible to limit dimensions of disposition regions of the first roller 50 and the second roller 52 to the minimum in the Z axis direction.

The first roller 50 and the second roller 52 are disposed with a gap in the Y axis direction therebetween. That is, in the transportation path of the paper P, the first roller 50 is positioned on an upstream side of the transportation path, and the second roller 52 is positioned on the downstream side of the transportation path. The gap is set to have a length less than the minimum length in a transportation path direction of the paper P corresponding to the printer 10.

Furthermore, in the front and back direction of the apparatus (in the Y axis direction in FIGS. 3 and 5) with respect to the recording head 70 to be described later of the recording section 28, the first roller 50 and the second roller 52 are positioned on a back side (in the +Y direction) with respect to the disposition region of the recording head 70, and are provided at the same position as a position of the disposition region of the recording head 70 in the height direction of the apparatus (in the Z axis direction). For this reason, it is possible to prevent the disposition region of the recording head 70 from overlapping the disposition regions of the first roller 50 and the second roller 52 in the height direction (in the Z axis direction) of the apparatus, and it is possible to suppress increase of the dimension in the height direction (in the Z axis direction) of the apparatus.

As illustrated in FIG. 5, the first roller 50 inverts the paper P fed from a side of the recording head 70 by using an outer circumferential surface thereof and thus, the first surface is on the bottom, and the second surface is on the top. Furthermore, an outer circumferential surface of the second roller 52 is in contact with the transportation path before the paper P is inverted by the first roller 50, that is, the inverted path 78, and is in contact with the transportation path after the paper P is inverted by the first roller 50, that is, the transportation path above the first and the second rollers 50 and 52 and thus, the second roller 52 exerts a transportation force on the paper P.

In FIG. 3, the first transportation driven roller 54 is positioned above a center shaft of the second roller 52 and on the front side of the apparatus, that is, on the side of the −Y direction, and is in contact with the second roller 52. That is, while the paper P is nipped between the second roller 52 and the first transportation driven roller 54, the first transportation driven roller 54 is rotationally driven to transport the paper P. The second transportation driven roller 56 is positioned on an upstream side in the transportation path of the first transportation driven roller 54, and on the side further in the +Z direction than the second roller 52 in the Z axis direction in FIG. 3. The second transportation driven roller 56 is in contact with the second roller 52. That is, while the paper P is nipped between the second roller 52 and the second transportation driven roller 56, the second transportation driven roller 56 is rotationally driven to transport the paper P to the first transportation driven roller 54.

For this reason, when the second roller 52 transports the paper P along the transportation path, the first transportation driven roller 54 and the second transportation driven roller 56 transport the paper P while nipping the paper P and thus, it is possible to reliably suppress oblique feeding of the paper P during the transportation. Furthermore, it is possible to send the paper P from the second roller 52 toward the recording head 70 in a natural posture and without difficulty.

The third transportation driven roller 58 is positioned on the upstream side in the transportation path of the second transportation driven roller 56, and the third transportation driven roller 58 is positioned on the side further in the +Z direction than the first roller 50 in the Z axis direction in FIG. 3, and is in contact with the first roller 50. That is, while the paper P is nipped between the first roller 50 and the third transportation driven roller 58, the third transportation driven roller 58 is rotationally driven to transport the paper P toward the second roller 52.

The pair of transportation rollers 64 is provided on a downstream side of the transportation path from a nipping position between the second roller 52 and the first transportation driven roller 54. While the paper P is nipped between the first roller 50 and the third transportation driven roller 58, and then between the second roller 52 and the second transportation driven roller 56, and then between the second roller 52 and the first transportation driven roller 54, that is, while the paper P is nipped in the sequence listed along the transportation path, the paper P is transported to the transportation rollers 64.

For this reason, when the paper P is transported by the first roller 50 and the second roller 52 along the transportation path, the paper P is transported while being nipped by the third transportation driven roller 58, and then by the second transportation driven roller 56 and then by the first transportation driven roller 54 in the sequence listed and thus, it is possible to reliably suppress oblique feeding of the paper P during the transportation.

In the transportation path, the length of the path from the nipping position between the second roller 52 and the first transportation driven roller 54 to a nipping position between the pair of transportation rollers 64 is set to be less than the minimum length in the transportation path direction of the paper P corresponding to the printer 10.

In the inverted path illustrated by the broken line in FIG. 5, the length of the inverted path is set to be greater than the maximum length in the transportation path direction of the paper P corresponding to the printer 10, in such a manner that leading edge and trailing edge sides in the transportation direction of the paper P do not overlap with each other in an inverted transportation path thereof.

For this reason, it is possible to prevent the diameter of the first roller 50 from becoming large, and to ensure that the inverted path 78 has sufficient length for the second roller 52 to invert the paper P. Since the second roller 52 can exert a transportation force on the inverted path before the paper P is inverted and on the transportation path after the paper P is inverted, it is possible to reduce the number of the rollers that are disposed, and to suppress an increase in cost.

The fourth transportation driven roller 60 is positioned on the side further in the −Z direction than the second roller 52 in the Z axis direction in FIG. 3, and is in contact with the second roller 52. Furthermore, the fifth transportation driven roller 62 is positioned on an upper stream side in the transportation path of the third transportation driven roller 58, and is provided on the feeding path section 48 of the back surface cover 22 forming a part of the transportation path from the medium container 20 to be in contact with the first roller 50. That is, while the paper P is nipped between the first roller 50 and the fifth transportation driven roller 62, the fifth transportation driven roller 62 is rotationally driven to transport the paper P toward the third transportation driven roller 58. When the back surface cover 22 to be described later is open with respect to the apparatus main body 12, the fifth transportation driven roller 62 separates from the first roller 50.

Herein, the transportation path of the paper P will be described again. The paper P fed from the upper stage tray 32 and the lower stage tray 34 is guided to the feeding path section 48 of the back surface cover 22, and is nipped by the first roller 50 and the fifth transportation driven roller 62. The paper P is fed along the outer circumferential surface of the first roller 50, and is nipped by the first roller 50 and the third transportation driven roller 58. The paper P is fed to the downstream side of the transportation path.

That is, the feeding path of the paper P fed from the medium container 20 (the upper stage tray 32 and the lower stage tray 34) converges with the transportation path formed by the first roller 50. For this reason, the first roller 50 forms not only the inverted path but also the non-inverted path. Accordingly, it is possible to achieve space saving and to reduce the number of components.

The paper P supported by the medium support tray 24 is drawn into the transportation path from a section between the fifth transportation driven roller 62 and the third transportation driven roller 58 in the transportation path via the medium support tray 24 and the feeding path section 80, and the leading edge of the paper P is nipped by the first roller 50 and the third transportation driven roller 58. The paper P fed from the medium support tray 24 converges with the transportation path of the paper P transported from the medium container 20 and is fed to the downstream side of the transportation path.

That is, a supply path of the paper P supplied from the medium support tray 24 converges with the transportation path formed by the first roller 50. For this reason, the first roller 50 can form the supply path of the medium from the medium support tray 24. Accordingly, it is possible to achieve space saving and to reduce the number of components.

As illustrated in FIG. 5, since the second roller 52 is positioned downstream of the first roller 50, it is possible to ensure the length (the length of the path of up to the recording section 28) of the supply path of the paper P supplied via the medium support tray 24. Accordingly, when a user manually supplies the paper P via the medium support tray 24, there is a problem in that the user inserts the paper P into the apparatus deep enough to significantly exceeding a recommended setting position. At this time, if the leading edge of the paper P reaches a position that faces the recording head 70, the recording head 70 cannot properly perform recording on the paper P. However, since it is possible to ensure the length of the supply path of the paper P supplied via the medium support tray 24, it is possible to prevent the problem from occurring.

Subsequently, the paper P is nipped by the second roller 52 and the second transportation driven roller 56. The paper P is fed to the downstream side of the transportation path, and is nipped by the second roller 52 and the first transportation driven roller 54. Thereafter, the paper P is further transported to the pair of transportation rollers 64. The paper P is nipped by the transportation rollers 64, and is fed to the recording section 28 on the downstream side of the transportation path, and recording is performed on the first surface of the paper P. After the recording is completed, the paper P is nipped by the discharge rollers 74, and is discharged to the discharge stacker 76 that is provided on the front side of the apparatus.

When the recording section 28 performs recording on both surfaces of the paper P in the printer 10, the recording section 28 performs the recording on the first surface of the paper P, and then while the trailing edge of the paper when the recording is performed on the first surface becomes the leading edge thereof due to a backward feeding operation of the transportation rollers 64 and the discharge rollers 74, the paper P is fed to the inverted path 78 which is positioned on the side further in the −Z direction than the second roller 52 in the Z axis direction.

The paper P fed to the inverted path 78 is nipped by the second roller 52 and the fourth transportation driven roller 60, and is fed to the outer circumferential surface on the side further in the −Z direction than the first roller 50. Along the outer circumferential surface of the first roller 50, the paper P is nipped again by the first roller 50 and the fifth transportation driven roller 62. Accordingly, the paper P is bent and inverted so that the first surface is on the bottom and the second surface is on the top. Thereafter, the paper P is fed along the transportation path to the recording section 28 by the transportations rollers 64 via the first roller 50, the third transportation driven roller 58, the second transportation driven roller 56, the first transportation driven roller 54 and the second roller 52.

For this reason, the second surface faces the recording head 70. The recording section 28 performs recording on the second surface, and the paper P is nipped by the discharge rollers 74 and is discharged to the discharge stacker 76 that is provided on the front side of the apparatus.

As described above, in the printer 10, since a plurality of the transportation driven rollers 54, 56, 58, 60 and 62 which are in contact with the first roller 50 and the second roller 52 are provided in the transportation section 26 along the transportation paths before and after the medium is inverted, the paper P can be smoothly transported in the transportation path and the inverted path 78.

Since while the paper P fed from the recording head 70 to the inverted path 78 is nipped between the second roller 52 and the fourth transportation driven roller 60, the paper P is transported toward the first roller 50, it is possible to smoothly invert the medium in the first roller.

Transportation Unit

Subsequently, the transportation unit 66 will be described with reference to FIGS. 6, 7A and 7B. The transportation unit 66 is configured to be attachable and detachable with respect to the apparatus main body 12. A method for attaching and detaching the transportation unit 66 with respect to the apparatus main body 12 will be described later.

The transportation unit 66 includes a unit main body 82 and a cover section 84. In the embodiment, a driven transmission unit 86 is provided in an end portion on the side further in the +X direction than the unit main body 82. The driven transmission unit 86 includes a first transmission gear 88, a second roller drive gear 90, a second transmission gear 92 and a first roller drive gear 94. The first transmission gear 88 engages with the second roller drive gear 90, and the second roller drive gear 90 engages with the second transmission gear 92, and the second transmission gear 92 engages with the first roller drive gear 94.

The second roller drive gear 90 is connected to the second roller 52 via a shaft that is not illustrated. The first roller drive gear 94 is connected to the first roller 50 via a shaft that is not illustrated.

In a state where the transportation unit 66 is attached to the apparatus main body 12, the driven transmission unit 86 of the transportation unit 66 is connected to a drive transmission unit 96 to be described later on a side of the apparatus main body 12, and receives a drive force from the drive transmission unit 96. That is, the driven transmission unit 86 drives the first roller 50 and the second roller 52 by using the drive force of the drive transmission unit 96 on the side of the apparatus main body 12. Accordingly, it is not necessary to provide a driving source in the transportation unit 66, and it is possible to prevent the weight of the transportation unit 66 from increasing.

In the embodiment, the first roller 50 and the second roller 52 are disposed in a center portion in a width direction (in an X axis direction in FIG. 7A) of the unit main body 82. The first roller 50 is disposed on a back end side (on a side of a +Y direction in FIG. 7A) of the unit main body 82. The second roller 52 is disposed with a gap on the side of the −Y direction from the first roller 50.

In the embodiment, the first roller 50 and the second roller 52 are set to have a diameter of the same dimension. For this reason, the first roller 50 and the second roller 52 can be made of a common configuration member, and it is possible to achieve low costs. Since the first roller 50 and the second roller 52 have the same diameter, it is possible to easily set circumferential velocities of the outer circumferences of the rollers, that is, paper transportation velocities, to be equal to each other by setting the numbers of rotations of both rollers to be the same. Since the first roller 50 and the second roller 52 have a diameter of the same dimension, it is possible to horizontally maintain the paper P that is transported in the transportation path which is formed between the unit main body 82 and the cover section 84 to be described later.

Since the first roller 50 and the second roller 52 can have the same paper transportation velocity, tension or deflection is not exerted on the paper P between the first roller 50 and the second roller 52. As a result, it is possible to reliably transport the paper P along the transportation path.

The first roller 50 and the second roller 52 are driven by a drive force from the first transmission gear 88. For this reason, the first roller 50 and the second roller 52 can have a common driving source. For this reason, since it is not necessary to provide the driving source for each of the first roller 50 and the second roller 52, it is possible to prevent costs from increasing.

Since the transportation unit 66 that is attachable and detachable with respect to the apparatus main body 12 is configured to have the first roller 50 and the second roller 52, when the transportation unit 66 is detached from the apparatus main body 12, the inverted path 78 provided in the apparatus main body 12 is exposed. Accordingly, it is possible to easily remove the jammed paper P when the paper P is jammed (when a paper jam occurs).

As illustrated in FIGS. 6 and 7A, the cover section 84 has a configuration in which the cover section 84 is attached to a rotationally moving shaft that is provided on the side further in the −Y direction than the unit main body 82, and can be opened and closed when the cover section 84 rotationally moves with respect to the unit main body 82. Specifically, as illustrated in FIG. 6, the cover section 84 can be closed with respect to the unit main body 82. As illustrated in FIG. 7A, the cover section 84 can be opened with the unit main body 82. As illustrated in FIG. 7A, the first transportation driven roller 54, the second transportation driven roller 56 and the third transportation driven roller 58 are rotatably provided on an inner surface 84*a* of the cover section 84.

When the cover section 84 is closed with respect to the unit main body 82, the first transportation driven roller 54, the second transportation driven roller 56 and the third transportation driven roller 58 are disposed on the inner surface 84*a* to be in contact with the first roller 50 and the second roller 52 at the positions illustrated in FIG. 5.

That is, when the cover section 84 is closed with respect to the unit main body 82, the first transportation driven roller 54 and the second transportation driven roller 56, and the third transportation driven roller 58 are respectively in contact with the second roller 52 and the first roller 50. When the cover section 84 is open with respect to the unit main body 82, the first transportation driven roller 54 and the second transportation driven roller 56, and the third transportation driven roller 58 respectively separate from the first roller 50 and the second roller 52.

For this reason, when the cover section 84 is open, it is possible to easily remove the paper P, for example, a small piece of the paper P, jammed inside the transportation unit 66.

The unit main body 82 includes an upper surface 82*a* and a lower surface 82*b*. When the cover section 84 is closed with respect to the unit main body 82, with a predetermined gap between the upper surface 82*a* and the inner surface 84*a*, the upper surface 82*a* faces the inner surface 84*a* of the cover section 84. That is, when the cover section 84 is closed with respect to the unit main body 82, the upper surface 82*a* and the inner surface 84*a* form a part of the transportation path of the paper P. When the transportation unit 66 is attached to the apparatus main body 12, the inverted path 78 (refer to FIGS. 3 and 5) is formed between the lower surface 82*b* and a support plate 98 (refer to FIGS. 3 and 5) of the apparatus main body 12.

The first roller 50 and the second roller 52 protrude to the transportation path and the inverted path 78 from the upper surface 82*a* and the lower surface 82*b* of the unit main body 82. Even when the cover section 84 is closed, the back end side (on the side of the Y direction in FIG. 6) of the unit main body 82 is open and is exposed.

When the transportation unit 66 is mounted onto the apparatus main body 12, and the back surface cover 22 is closed with respect to the apparatus main body 12, the back end side (on the side of the Y direction in FIG. 6) of the unit main body 82 faces the feeding path section 48 of the back surface cover 22. Accordingly, the back end side of the unit main body 82 and the feeding path section 48 form a part of the transportation path from the medium container 20 and a part of the inverted path 78.

The first roller 50 protrudes from the back end side of the unit main body 82 to the transportation path that is formed by the back end portion and the feeding path section 48. For this reason, the outer circumferential surface of the first roller 50 protrudes to the transportation path and the inverted path from the upper surface 82*a*, the back end side and the lower surface 82*b* of the unit main body 82, and rotation of the first roller 50 can be used to transport the paper P.

In both end portions in a width direction (in an X axis direction in FIG. 6) of the back end side (the side of the +Y direction in FIG. 6) of the unit main body 82, grasping sections 100 are provided to protrude to the side of the +Y direction. For this reason, when the transportation unit 66 is attached and detached with respect to the apparatus main body 12, good workability is obtained.

In each end portion in the width direction (in an X axis direction in FIG. 7B) of the unit main body 82, a protrusion 102 (refer to FIGS. 6 and 7B) is provided on the lower surface 82*b* of the unit main body 82 to protrude in a −Z direction in FIG. 7B from the lower surface 82*b*. In each end portion in the width direction (in the X axis direction in FIG. 6) of the back end side (the side of the +Y direction in FIG. 6) of the unit main body 82, a pressed section 104 is provided. The protrusion 102 and the pressed section 104 will be described in detail later.

Subsequently, the back surface cover 22 and a mounting section 106 (refer to FIG. 10A) of the transportation unit 66 of the apparatus main body 12 will be described with reference to FIGS. 8, 9A, 9B, 10A and 10B. In FIG. 8, the back surface cover 22 is open with respect to the apparatus main body 12. At this time, the transportation unit 66 is mounted onto the apparatus main body 12. For this reason, when the back surface cover 22 and the medium support tray 24 provided on the back surface cover 22 are open with respect to the apparatus main body 12, at least parts of the back end side (the side of the +Y direction in FIG. 6) of the transportation unit 66 and the first roller 50 are exposed to the outside of the apparatus main body 12.

Accordingly, a part of the transportation path from the medium container 20 and a part of the supply path from the medium support tray 24 are exposed to the outside of the apparatus main body 12. In addition, at least a part of the first roller 50 is exposed, thereby causing the paper P jammed in the transportation path and the supply path to be exposed. Accordingly, it is possible to easily remove the paper P and to easily perform a paper jam release operation.

When the back surface cover 22 is open with respect to the apparatus main body 12, the first roller 50 of the transportation unit 66 separates from the fifth transportation driven roller 62 that is provided on the inside of the back surface cover 22. For this reason, when the paper P fed from the medium container 20 is jammed in the transportation path from the medium container 20, it is possible to easily remove the paper P.

In FIGS. 9A and 9B, the feeding path section 48 is provided on the inside of the back surface cover 22 to form a part of the transportation path. A pressing section 108 is provided in each end portion in an X axis direction in FIG. 9A of the back surface cover 22. When the back surface cover 22 is closed with respect to the apparatus main body 12, the pressing sections 108 are provided on the back surface cover 22 at positions where the pressing sections 108 engage with the pressed sections 104 of the transportation unit 66.

Accordingly, when the transportation unit 66 is mounted onto the apparatus main body 12 and the back surface cover 22 is closed with respect to the apparatus main body 12, the transportation unit 66 is mounted onto the apparatus main body 12, the pressed section 104 and the pressing section 108 engage each other. That is, in a state where the back surface cover 22 is closed with respect to the apparatus main body 12, the back surface cover 22 is in contact with the transportation unit 66 and thus, a closed posture of the back surface cover 22 is regulated.

For this reason, a relative position relationship between the back surface cover 22 and the transportation unit 66 is accurately determined. Accordingly, when the transportation path of the paper P is formed by the back surface cover and the transportation unit 66, the feeding path section 48 of the back surface cover 22 faces the back end side of the transportation unit 66 while a proper gap is maintained between the feeding path section 48 and the back end side. As a result, it is possible to properly form the transportation path of the paper P.

Subsequently, FIG. 10A illustrates a state where the transportation unit 66 is detached from the apparatus main body 12. When the back surface cover 22 is open, the apparatus main body 12 is provided with the mounting section 106 that is exposed toward the back surface side (a side of a +Y direction in FIG. 10A) of the apparatus. It is possible to mount the transportation unit 66 on the mounting section 106 by inserting the transportation unit 66 from the back surface side of the apparatus, that is, from the side of the +Y direction to a side of a −Y direction.

That is, since the transportation unit 66 is mounted onto the mounting section 106 that is exposed when the openable and closeable back surface cover 22 provided on the apparatus main body 12 is open, it is possible to prevent a user from unintentionally dropping the transportation unit 66. Since the transportation unit 66 is not configured to have a member forming an exterior of the apparatus main body as an element, that is, the back surface cover 22 and the transportation unit 66 are separately configured, it is possible to reduce the weight of the transportation unit 66, and to obtain good workability when attaching and detaching the transportation unit 66 with respect to the apparatus main body 12. Even in a case where the size of the printer 10 becomes large, it is possible to prevent the weight of the transportation unit 66 from increasing, and to ensure good handleability.

FIG. 10B illustrates an end portion on a side of a +X direction in a width direction (in an X axis direction in FIGS. 10A and 10B) of the mounting section 106. On the support plate 98 forming the inverted path 78 of the apparatus main body 12, a sloping surface 110 is provided in the end portion on the side of the +X direction in the width direction. The sloping surface 110 is provided in the end portion on the side further in the −X direction than the support plate 98 (not illustrated), and the sloping surface 110 engages with the protrusion 102 of the transportation unit 66 at a second position (refer to FIG. 13A) to be described to configure retention means 112 that retains the transportation unit 66 at the second position.

Transmission of Power to Transportation Unit

Subsequently, the following will be described with reference to FIGS. 11A, 11B, 12A, 12B, 13A and 13B: a method for attaching and detaching the transportation unit 66 with respect to the apparatus main body 12 and a connection and disconnection of power transmission means.

In FIGS. 11A and 11B, the drive transmission unit 96 of the apparatus main body 12 is connected to the driven transmission unit 86 of the transportation unit 66. In a state where the drive transmission unit 96 and the driven transmission unit 86 are connected to each other, in the front and back direction (in a Y axis direction in FIG. 11A) of the apparatus, a position of the transportation unit 66 with respect to the apparatus main body 12 is referred to as a first position Y1 (refer to FIG. 11B).

Herein, the drive transmission unit 96 is configured to have a gear train that is configured to have a plurality of gears. A drive gear 114 is positioned at one end of the row of gear train, and is connected to the drive motor 116. A third transmission gear 118 is positioned at the other end thereof, and engages with the first transmission gear 88 of the driven transmission unit 86. Herein, the drive transmission unit 96 is configured in such a manner that the third transmission gear 118 always rotates in a counter-clockwise direction no matter which direction the drive motor 116 rotates in.

For this reason, when the drive transmission unit 96 and the driven transmission unit 86 are connected to each other at the first position Y1, due to a rotational drive force of the drive motor 116, the first roller drive gear 94 and the second roller drive gear 90, that is, the first roller 50 and the second roller 52, are rotationally driven in a counter-clockwise direction, that is, in a direction in which the paper P is fed along the transportation path.

Subsequently, a second position Y2 will be described with reference to FIGS. 12A, 12B and 13A. In the front and back direction (in a Y axis direction in FIGS. 12B and 13A) of the apparatus, the second position Y2 (refer to FIGS. 12B and 13A) indicates a position at which the driven transmission unit 89 is positioned after the driven transmission unit 86 separates from the drive transmission unit 96, that is, after the transportation unit 66 pulls out with respect to the first position Y1.

In FIG. 12A, when the back surface cover 22 is open with respect to the apparatus main body 12, the engagement between the pressed section 104 of the transportation unit 66 and the pressing section 108 is released. For this reason, the regulation in the Y axis direction of the transportation unit 66 is released with respect to the apparatus main body 12. Accordingly, the transportation unit 66 can be displaced to a side of a +Y direction with respect to the apparatus main body 12.

Herein, when a user grasps the grasping section 100 to slide the transportation unit 66 in the +Y direction, as illustrated in FIG. 12B, the transportation unit 66 moves from the first position Y1 to the second position Y2 in the Y axis direction. Accordingly, the engagement between the third transmission gear 118 of the drive transmission unit 96 and the first transmission gear 88 of the driven transmission unit 86 is released. That is, the driven transmission unit 86 separates from the drive transmission unit 96, and the drive force of the drive motor 116 is not transmitted to the driven transmission unit 86.

For this reason, the first transmission gear 88, the second roller drive gear 90, the second transmission gear 92 and the first roller drive gear 94 of the driven transmission unit 86 are freely rotatable. Accordingly, the first roller 50 and the second roller 52 rotated by the driven transmission unit 86 are freely rotatable.

At this time, if the transportation unit 66 slides from the first position Y1 to the second position Y2, the protrusion 102 of the transportation unit 66 engages with the sloping surface 110 that is provided on the support plate 98. Accordingly, when a pullout force equal to or smaller than a predetermined magnitude is exerted on the transportation unit 66, the transportation unit 66 is retained at the second position Y2 in the Y axis direction by the retention means 112 that is configured to have the protrusion 102 and the sloping surface 110.

Accordingly, in a state where the transportation unit 66 is mounted onto the apparatus main body 12, the transportation unit 66 is configured to be displaceable between the first position Y1 at which the driven transmission unit 86 is connected to the drive transmission unit 96 and the second position Y2 at which the driven transmission unit 89 is positioned after the driven transmission unit 86 separates from the drive transmission unit 96, that is, after the transportation unit 66 pulls out with respect to the first position Y1.

Furthermore, when a pullout force equal to or larger than a predetermined magnitude is exerted on the transportation unit 66, the protrusion 102 climbs over the sloping surface 110 along a +Z direction in FIG. 13A and thus, the retention means 112 can release the retention of the transportation unit 66 at the second position Y2. For this reason, as shown in FIG. 13B, the transportation unit 66 moves from the mounting section 106 of the apparatus main body 12 to the outside of the apparatus main body 12, and is detached from the apparatus main body 12.

That is, if a pullout force equal to or larger than a predetermined magnitude is applied to the transportation unit 66, it is possible to pull out the transportation unit 66 from the mounting section 106. Accordingly, when the transportation unit 66 is pulled out good workability is obtained compared to a configuration in which the transportation unit 66 is completely locked at the second position Y2.

When the transportation unit 66 is mounted onto the apparatus main body 12, the transportation unit 66 is inserted onto the mounting section 106 in the +Y direction in FIG. 13B. In a state where the transportation unit 66 is positioned at the second position Y2 with respect to the apparatus main body 12, the back surface cover 22 is closed with respect to the apparatus main body 12. Accordingly, the pressing section 108 (refer to FIG. 9A) of the back surface cover 22 engages with the pressed section 104 (refer to FIG. 8) of the transportation unit 66, and the pressed section 104 is pressed in a −Y direction, and the transportation unit 66 is pressed into the first position Y1. Accordingly, the driven transmission unit 86 is connected to the drive transmission unit 96, and a drive force from the drive motor 116 is transmitted to the driven transmission unit 86.

Subsequently, when the paper P is jammed in the transportation path formed by the transportation unit 66, a paper jam release process will be described with reference to FIGS. 11A, 11B, 12A, 12B, 13A and 13B again.

In FIG. 11A, when the paper P is jammed in the transportation path, first, the back surface cover 22 is open with respect to the apparatus main body 12. Accordingly, the transportation path from the medium container 20 to the transportation unit 66 is exposed and thus, it is possible to confirm the paper P that causes a paper jam. Accordingly, it is possible to easily remove the paper P that causes a paper jam in the transportation path from the medium container 20 to the transportation unit 66.

Subsequently, when a paper jam occurs in a state where the paper P is nipped by the first roller 50, the second roller 52, the first transportation driven roller 54, the second transportation driven roller 56 and the third transportation driven roller 58, if the back surface cover is open with respect to the apparatus main body 12, a part of the paper P jammed on the outside, that is, on the back end side of the transportation unit 66, is exposed. At this time, since the driven transmission unit 86 of the transportation unit 66 is connected to the drive transmission unit 96, a force of pulling out the paper P nippped between the rollers is larger than a force of retaining the transportation unit 66 at the first position Y1. For this reason, when a user pulls out the paper P that is exposed to the outside from the back end side of the transportation unit 66, it is possible to move the transportation unit 66 from the first position Y1 to the second position Y2.

For this reason, since the driven transmission unit 86 of the transportation unit 66 separates from the drive transmission unit 96 at the second position Y2, a drive force is not transmitted to the transportation unit 66. That is, since the first roller 50 and the second roller 52 of the transportation unit 66 are freely rotatable, it is possible to easily pull out the paper P in contact with the first roller 50 and the second roller 52, and to easily perform a paper jam release operation.

Furthermore, even in a case where the paper P is nipped at multiple positions, when only a connection between the drive transmission unit 96 and the driven transmission unit 86 is released, a drive force is not transmitted to the entirety of the transportation unit 66, that is, each of the rollers are freely rotatable at the multiple nipping positions (a position between the first roller 50 and the third transportation driven roller 58, a position between the second roller 52 and the second transportation driven roller 56, and a position between the second roller 52 and the first transportation driven roller 54) of the paper P. In a configuration in which the paper P is nipped at multiple positions, it is possible to avoid complexity of the structure and to easily remove the paper P.

When a user pulls out the paper P of which a part is nipped by the first roller 50, the second roller 52, the first transportation driven roller 54, the second transportation driven roller 56 and the third transportation driven roller 58, and appears on the outside of the transportation unit 66, that is, on the back end side thereof, the transportation unit 66 moves to the second position Y2 and thus, it is not necessary for the user to move the transportation unit 66 from the first position Y1 to the second position Y2, and good workability is obtained.

Since the printer 10 includes the retention means 112, that is, the protrusion 102 and the sloping surface 110, which retains the transportation unit 66 at the second position Y2, when the transportation unit 66 moves from the first position Y1 to the second position Y2, the retention means 112 can prevent the transportation unit 66 from unintentionally returning to the first position Y1 during a paper jam release operation of the paper P.

Since the printer 10 includes the retention means 112 that retains the transportation unit 66 at the second position Y2, when a user pulls out the paper P that is nipped by the first roller 50, the second roller 52, the first transportation driven roller 54, the second transportation driven roller 56 and the third transportation driven roller 58 in a state where the transportation unit 66 is retained at the second position Y2, the retention of transportation unit 66 at the second position Y2 is maintained, and the paper P is pulled out from between the first roller 50 and the third transportation driven roller 58, between the second roller 52 and the second transportation driven roller 56, and between the second roller 52 and the first transportation driven roller 54.

That is, since a force of retaining the transportation unit 66 at the second position Y2 is larger than a force of pulling out the paper P from the transportation unit 66, when the paper P is pulled out from the transportation unit 66, it is possible to avoid such a problem that the transportation unit 66 is also pulled out from the apparatus main body 12 while being accompanied by the paper P.

Modification Example of First Embodiment (1) In the configuration of the embodiment, one each of the first roller 50 and the second roller 52 are provided at the center in a direction that intersects with the transportation direction of the paper P, that is, in the width direction of the unit main body 82 of the transportation unit 66. However, the embodiment may have a configuration in which at least any one of the first roller 50 and the second roller 52 is provided at multiple positions along the direction that intersects with the transportation direction of the paper P, that is, along the width direction of the unit main body 82. In particular, in a configuration in which the plurality of second rollers 52 are provided in the width direction, since the paper P is in contact with the second roller 52 at multiple positions in the width direction of the paper P and thus, it is possible to suppress oblique feeding of the paper P during the transportation thereof.

(2) In a configuration in which at least any one of the first roller 50 and the second roller 52 is provided at multiple positions along the direction that intersects with the transportation direction of the paper P, that is, along the width direction of the unit main body 82, a plurality of the first transportation driven rollers 54 and the second transportation driven rollers 56, and a plurality of the third transportation driven rollers 58 may be provided to be respectively in contact with the second rollers 52 and the first rollers 50. With this configuration, it is possible to further prevent the oblique feeding of the paper P during the transportation thereof.

(3) In the configuration of the embodiment, the protrusion 102 of the retention means 112 is provided on a side of the transportation unit 66, and the sloping surface 110 of the retention means 112 is provided on a side of the apparatus main body 12. However, the embodiment may have a configuration in which the protrusion 102 is provided on the side of the apparatus main body 12, and the sloping surface 110 is provided on the side of the transportation unit 66.

(4) In the configuration of the embodiment, the first roller 50 and the second roller 52 transport the paper P by using the outer circumferential surfaces thereof. However, the embodiment may have a configuration in which an endless belt is wound around between the first roller 50 and the second roller 52, and the endless belt driven by rotation of the first roller 50 and the second roller 52 transports the paper P.

Second Embodiment

FIGS. 14 and 15 illustrate a printer 120 according to a second embodiment of the invention. The printer 120 is different from that of the first embodiment in that the first transportation driven roller 54, the second transportation driven roller 56 and the third transportation driven roller 58 are not provided on a transportation unit 122 but on an apparatus main body 124.

As illustrated in FIGS. 14 and 15, the printer 120 is configured in such a manner that the transportation unit 122 is attachable and detachable with respect to the apparatus main body 124. The back surface cover 22 is open and closed, and the transportation unit 122 is attached and detached with respect to the apparatus main body 124. Similarly to in the first embodiment, the transportation unit 122 is provided with the first roller 50 and the second roller 52. Similarly to in the first embodiment, when the transportation unit 122 is mounted onto the apparatus main body 124, and the drive transmission unit 96 of the apparatus main body 124 is connected to the driven transmission unit 86 of the transportation unit 122, the first roller 50 and the second roller 52 are rotationally driven by a drive force supplied from the apparatus main body 124.

When the transportation unit 122 is mounted onto the apparatus main body 124, the apparatus main body 124 is provided with the first transportation driven roller 54, the second transportation driven roller 56 and the third transportation driven roller 58 in such a manner that the first transportation driven roller 54 and the second transportation driven roller 56, and the third transportation driven roller 58 are respectively in contact with the second roller 52 and the first roller 50.

The pressed section 104 (refer to FIGS. 6 and 8) is provided on a back end side of the transportation unit 122. In contrast, the pressing section 108 (refer to FIGS. 9A and 9B) is provided on a side of the inner surface of the back surface cover 22, that is, on a side of the back surface cover 22, which faces the apparatus main body 124.

In the embodiment, when the transportation unit 122 is mounted onto the apparatus main body 124, and the back surface cover 22 is closed, the pressed section 104 and the pressing section 108 are in contact with each other, and the pressing section 108 presses the pressed section 104. Accordingly, the transportation unit 122 moves from the second position Y2 to a front side (a side of a −Y direction in FIGS. 14 and 15) of the apparatus with respect to the apparatus main body 124, and the transportation unit 122 is positioned at the first position Y1. Accordingly, the drive transmission unit 96 is connected to the driven transmission unit 86, and the paper P can be transported.

When the transportation unit 122 is mounted onto the apparatus main body 124, and the back surface cover 22 is open with respect to the apparatus main body 124, the engagement between the pressed section 104 and the pressing section 108 is released. When the pressed section 104 and the pressing section 108 disengage each other, the apparatus main body 124 is provided with bias means which is not illustrated and biases the transportation unit 122 in a +Y direction in FIG. 15. Accordingly, in the embodiment, when the back surface cover 22 is open with respect to the apparatus main body 124, the transportation unit 122 is displaced from the first position Y1 to the second position Y2 by the bias means which is not illustrated.

That is, in the embodiment, when the back surface cover 22 is closed, the transportation unit 122 is retained at the first position Y1 by the back surface cover 22. When the closed back surface cover 22 is open, the transportation unit 122 is displaced from the first position Y1 to the second position.

Accordingly, since the transportation unit 122 is displaced from the first position Y1 to the second position Y2, it is not necessary for a user to move the transportation unit 122 itself from the first position Y1 to the second position Y2, and good workability is obtained.

Modification Example of Second Embodiment (1) In the configuration of the embodiment, the first roller 50 and the second roller 52 are driven by a common drive motor 116. In replacement of this configuration, the embodiment may have a configuration in which the first roller 50 and the second roller 52 are rotationally driven by independent drive motors, respectively.

(2) In the configuration of the embodiment, the first roller 50 and the second roller 52 have a diameter of the same dimension. In replacement of this configuration, the embodiment may have a configuration in which the first roller 50 and the second roller 52 have diameter dimensions that are different from each other.

(3) In the embodiment, one each of the first roller 50 and the second roller 52 is configured as a drive roller. However, in replacement of this configuration, a plurality of the first rollers 50 and the second rollers 52 are configured as drive rollers.

(4) Even in the configuration of the embodiment, at least any one of the first roller 50 and the second roller 52 may be provided at multiple positions along a direction that intersects with the transportation direction of the paper P, that is, along a width direction of the transportation unit 122. A plurality of the first transportation driven roller 54, the second transportation driven roller 56 and the third transportation driven roller 58 may be provided in a width direction of the apparatus main body 124.

In addition, in each of the embodiments described above, the transportation units 66 and 122 are applied to an ink jet printer as an example of the recording apparatus. However, the transportation units 66 and 122 are also typically applicable to other liquid ejecting apparatuses.

Herein, the liquid ejecting apparatus is not limited to a printer, a copying machine, a facsimile and the like that uses an ink jet type recording head, and performs recording on a recording medium by discharging ink from the recording head. The liquid ejecting apparatus includes an apparatus that ejects liquid suitable for the purpose instead of ink on an ejected medium equivalent to the recorded medium from a liquid ejecting head equivalent to the ink jet type recording head, and adheres the liquid on the ejected medium.

In addition to the recording head describe above, there are following liquid ejecting heads: a color material ejecting head used in manufacturing a color filter such as a liquid crystal display; an electrode material (electric conductive paste) ejecting head used in forming an electrode of an organic EL display, a field emission display (FED) or the like; a living organic matter ejecting head used in manufacturing a biochip; a specimen ejecting head as a precision pipette; and the like.

The invention is not limited to the embodiments described above. The invention can be modified in various forms insofar as the modifications do not depart from the scope of the invention, which is described in the claims. The scope of the invention includes the modifications.

The entire disclosure of Japanese Patent Application No. 2013-072571 filed on Mar. 29, 2013, and No. 2013-071633 filed on Mar. 29, 2013 are expressly incorporated by reference herein.

What is claimed is:

1. A recording apparatus comprising:

a recording head that performs recording on both sides of a medium;

a feeding path that feeds the medium from a media container;

a first roller that inverts the medium which is transported from the feeding path toward the recording head;

a second roller that is located downstream of the first roller and which exerts a transportation force on the medium;

a transportation path that is located downstream of the feeding path and transports the medium to the recording head; and a reverse side recording path that transports the medium toward the first roller to invert, wherein a part of the transportation path includes upper side faces of the first roller and the second roller, and a part of the reverse side recording path includes lower side faces of the first roller and the second roller, and wherein when the recording head performs recording on a reverse side of the medium, the medium is transported toward the reverse side recording path after the recording is performed on the reverse side of the medium.

2. The recording apparatus according to claim 1, wherein the first and the second rollers are provided at the same position in a height direction of the apparatus.

3. The recording apparatus according to claim 2, wherein the first and the second rollers are provided at the same position as a position of a disposition region of the recording head in the height direction of the apparatus.

4. The recording apparatus according to claim 2, wherein the first and the second rollers have the same diameter.

5. The recording apparatus according to claim 2, wherein the first and the second rollers have the same medium transportation velocity.

6. The recording apparatus according to claim 1, wherein the first and the second rollers are provided at the same position as a position of a disposition region of the recording head in the height direction of the apparatus.

7. The recording apparatus according to claim 3, wherein the first and the second rollers have the same diameter.

8. The recording apparatus according to claim 1, wherein the first and the second rollers have the same diameter.

9. The recording apparatus according to claim 1, wherein the first and the second rollers have the same medium transportation velocity.

10. The recording apparatus according to claim 1, wherein the first and the second rollers are driven by a common driving source.

11. The recording apparatus according to claim 1, wherein a plurality of the second rollers are provided in a medium width direction that intersects with a medium transportation direction.

12. The recording apparatus according to claim 1, wherein the first and the second rollers are provided with a plurality of driven rollers along the transportation path before the inversion of the medium and the transportation path after the inversion of the medium.

13. The recording apparatus according to claim 1, further comprising:

a first driven roller that is rotationally driven while the medium is nipped between the second roller and the first driven roller; and a second driven roller that is provided on an upstream side of the first driven roller in the medium transportation direction, and is rotationally driven while the medium is nipped between the second roller and the second driven roller.

14. The recording apparatus according to claim 13, further comprising:

a third driven roller that is rotationally driven while the medium is nipped between the first roller and the third driven roller.

15. The recording apparatus according to claim 14, further comprising:

a fourth driven roller that is rotationally driven while the medium fed from the recording head toward the first roller is nipped between the second roller and the fourth driven roller.

16. The recording apparatus according to claim 13, wherein the first driven roller is positioned above a center shaft of the second roller in the height direction of the apparatus, and on a front side of the apparatus in a front and back direction of the apparatus.

17. The recording apparatus according to claim 16, wherein the recording apparatus main body has an opening/closing body that is openable and closeable, and when the opening/closing body is open, a unit body is attachable and detachable.

18. The recording apparatus according to claim 1, further comprising:

a medium container that can contain a plurality of the mediums, wherein a feeding path of the medium fed from the medium container converges with the transportation path formed by the first roller.

19. The recording apparatus according to claim 1, further comprising:

a medium support tray that supports the medium that is not yet fed, wherein a supply path of the medium supplied via the medium support tray converges with the transportation path formed by the first roller.

20. The recording apparatus according to claim 1, wherein a unit body that is attachable and detachable with respect to a recording apparatus main body is configured to have the first and the second rollers.

21. The recording apparatus according to claim 1, wherein the first roller and the second roller are rotated in the same direction both before and after the medium is inverted.

22. The recording apparatus according to claim 1, wherein the first roller converges with the feeding path that provides the medium from the media container toward the recording head, a part of the transportation path transporting the medium from the feeding path to the recording head before the medium is inverted, and a part of the transportation path transporting the medium to the recording head after the medium is inverted.

* * * * *